US007392986B2

(12) United States Patent
Gress

(10) Patent No.: US 7,392,986 B2
(45) Date of Patent: Jul. 1, 2008

(54) METHOD AND APPARATUS FOR CARD GAME

(76) Inventor: Edmund A. Gress, 1220 Littlemeadow Rd., Guilford, CT (US) 06437

( * ) Notice: Subject to any disclaimer, the term of this patent is extended or adjusted under 35 U.S.C. 154(b) by 0 days.

(21) Appl. No.: 10/971,413

(22) Filed: Oct. 22, 2004

(65) Prior Publication Data

US 2005/0151320 A1 Jul. 14, 2005

Related U.S. Application Data

(63) Continuation-in-part of application No. 09/693,145, filed on Oct. 20, 2000, now Pat. No. 6,893,021.

(60) Provisional application No. 60/514,234, filed on Oct. 24, 2003, provisional application No. 60/208,532, filed on Jun. 1, 2000.

(51) Int. Cl.
*A63F 1/00* (2006.01)

(52) U.S. Cl. ..... 273/292; 273/298; 273/302; 273/308; D21/376; D21/382; D21/384

(58) Field of Classification Search ..... 273/292, 273/298, 302, 308, 244.2, 244, 246, 247, 273/255, 262; D21/382–384, 376
See application file for complete search history.

(56) References Cited

U.S. PATENT DOCUMENTS 3,167,313 A * 1/1965 Davenport et al. ..... 273/262
5,467,997 A * 11/1995 Bashirzadeh ..... 273/302
6,481,714 B1 * 11/2002 Jacobs ..... 273/236
6,554,702 B2 * 4/2003 Mahar et al. ..... 463/11
6,601,851 B1 * 8/2003 Sakamoto et al. ..... 273/308
6,626,434 B2 * 9/2003 Tanaka ..... 273/292
2002/0043764 A1 * 4/2002 Imhof ..... 273/292
2003/0188465 A1 * 10/2003 Ruiz ..... 40/124.01

FOREIGN PATENT DOCUMENTS

DE 2726550 6/1977
DE 2726550 A1 * 6/1979

OTHER PUBLICATIONS

"Singles", The Great Amierican Book of Sidewalk, Stoop, Dirt, Curb, and Alley Games, by Fred Ferretti, Workman Publishing Company, pp. 86-91.*
International Search Report dated May 25, 2005.

* cited by examiner

*Primary Examiner*—Benjamin H Layno
(74) *Attorney, Agent, or Firm*—Ohlandt, Greeley, Ruggiero & Perle L.L.P.

(57) ABSTRACT

A method for playing a competitive card game simulating combat between a first character and a second character has the step of providing a stack of playing cards for each player with each card representing at least one specific character. Each card has games on the card and the card has indicia thereon representing various information about the first character and the second character with statistics. The method also has the steps of selecting a statistical comparison game, selecting a card from the stack of each player, and choosing one category of the statistics to be compared. The game also has the step of comparing the statistics of the specific character on the chosen category to determine a winner of the card game.

14 Claims, 18 Drawing Sheets

20 18 22

Ranking 3 JOEY DOE POP 265

16

14

| | | | | |
|---|---|---|---|---|
| Height | 6'2" | 0-8 | | 0 POP |
| Weight | 245 lbs | 9-23 | Slap | 15 POP |
| # of Titles | 0 | 24-62 | Punch | 20 POP |
| Arm | 21" | 63-72 | Aerial Move | 25 POP |
| Chest | 58" | 73-88 | Table Crunch | 30 POP |
| Crowd Appeal | 97 | 98-99 | Signature Moves | 50 POP |

24 26

22

18

16

26

10

22

16

18

26

10

METHOD AND APPARATUS FOR CARD GAME

CROSS REFERENCE TO RELATED PATENT APPLICATIONS

This patent application claims priority to U.S. Provisional Patent Application Ser. No. 60/514,234 filed on Oct. 24, 2003 and claims priority to U.S. patent application Ser. No. 09/693,145, now U.S. Pat. No. 6,893,021, filed on Oct. 20, 2000 which claims priority of U.S. Provisional Patent Application No. 60/208,532 filed on Jun. 1, 2000.

BACKGROUND OF THE INVENTION

1. Field of the Invention

The present invention relates generally to card games, electronic simulations, and methods of playing same. More particularly, it relates to card games for simulating sports and the arts of encounterment, and methods of playing the same.

2. Description of the Related Art

There have been a number of card games developed for simulating various sporting events including wrestling matches. Two patents that depict simulated wrestling matches are U.S. Pat. Nos. 4,861,031 and 5,163,688, both by inventor Cosmian E. Simms. These patents describe cards with images of various wrestling maneuvers thereon. The players determine the sequence to display their cards in order to gain a strategic advantage during play. While the games described in U.S. Pat. Nos. 4,861,031 and 5,163,688 do simulate wrestling matches, they do not take advantage of the burgeoning popularity of professional wrestling today as they do not use any of the images or statistics of actual wrestlers.

SUMMARY OF THE INVENTION

It is an object of the present invention to provide playing card games simulating sports and arts of encounterment, and methods for playing same, which overcome the drawbacks of the prior art games.

It is another object of the present invention to provide such a game and methods in which playing cards having information thereon, which is compared to determine the winner of the games.

It is still another object of the present invention to provide such games and methods in which the information on the playing cards includes rankings, statistics, a total amount of punishment rating and encounterment move punishment ratings for the depicted character or object.

It is a further object of the present invention to provide such games and methods which may be easily used by persons of all ages.

It is yet a further object of the present invention to provide such games and methods for simulating wrestling.

It has now been found that the foregoing and related objects and advantages of the present invention can be readily attained in an apparatus or game for playing various competitive card games simulating sports and arts of encounterment, such as wrestling matches, which includes a plurality of playing cards with each card represents a specific character or object and having indicia thereon representing various information about the participant. The information on the cards is used and compared during the playing of the competitive card games to determine a winner of the card games.

Desirably, the information on each card includes an image of a specific character or object, such as a wrestler. The information on each card should also include one or more of the following: (1) a ranking of the specific character or object represented thereon; (2) a rating of total amount of punishment that the specific character or object represented thereon can sustain; (3) a rating of punishment of each move that the specific character or object represented thereon can inflict on an opponent; and (4) statistics of the specific character or object. Examples of suitable statistics include, but are not limited to, height, weight, number of titles, bicep/tricep size, chest size and crowd appeal. Alternatively, each combatant has a statistic that bears predetermined relationship to an image thereon such as a child, a monster, a solider, etc.

In one embodiment of using the apparatus or game or system to perform the method for playing various competitive card games simulating sports and arts of encounterment, information on the selected cards are compared to determine a winner of the card game.

In another embodiment of the method, the rankings of the character or object represented on the selected cards are compared and the player with the card having the lowest ranking wins the cards of the other player(s).

In yet another embodiment of the method, the comparing step includes each player sequentially selecting moves to be performed from the selected card of the player and subtracting the ratings of punishment of the selected moves from the ratings of total amount of punishment of the selected card of the other player until one of the players depletes the total amount of the punishment endurance of the other player.

In still yet another embodiment of the method, during the comparison step, at least one of the statistics of the character or object represented on the selected cards are compared and the player with the card having the highest statistic wins the cards of the other player(s).

The present invention will be fully understood when reference is made to the following detailed description taken in conjunction with the accompanying drawings.

DETAILED DESCRIPTION OF THE INVENTION

In one embodiment of the present invention, a system/apparatus or game for playing card games simulating sports and/or arts of encounterment and combat is provided. The system includes a card or a set of cards having thereon various indicia used in playing the card games. Such indicia may include, for example, an indication of the identification of the character or object represented thereon. The identification may be textual, graphical or a combination of text and graphics. The indicia may also include a ranking of a specific character or object represented thereon, a rating of total punishment that the specific character or object represented thereon can sustain, a rating of punishment of each move that the specific character or object represented thereon can inflict on an opponent, statistics of the specific character or object represented thereon, or any combinations thereof. The system may also include means or a way for selecting a number from a total numerical range of numbers.

Examples of suitable sports and/or arts of encounterment include, but are not limited to, wrestling; space battle; fencing; jousting; boxing; martial arts, such as karate, kickboxing, and judo; fantastical and science fiction encounters, such as monster fighting, alien fighting, and spaceship battles; military encounters, such as ground battles, sea battles, and air battles; or any combinations thereof. Examples of suitable characters and/or objects include, but are not limited to, wrestlers; fencers; boxers; knights; martial arts participants; creatures; monsters; spaceships; naval vessels, such as submarines, carriers, destroyers and battleships; soldiers; aircraft such as jets, winged vehicles, helicopters, and propeller-driven planes; artifacts; or any combinations thereof. Thus, the cards of the present system may be used to simulate a variety of real-world and fictional games and events using obvious variants from the systems and methods described herein.

In another embodiment of the present invention, a system/apparatus or game for playing card games simulating wrestling is provided. The system includes a card or a set of cards having thereon various indicia used in playing the card game. Such indicia may include, for example, an indication of the identification of the wrestler represented thereon. The identification may be textual, graphical or a combination of text and graphics. The indicia may also include a ranking of the specific wrestler represented thereon, a rating of total punishment that the specific wrestler represented thereon can sustain, a rating of punishment of each move that the specific wrestler represented thereon can inflict on an opponent, statistics of the specific wrestler represented thereon, or any combinations thereof.

Figure 1:
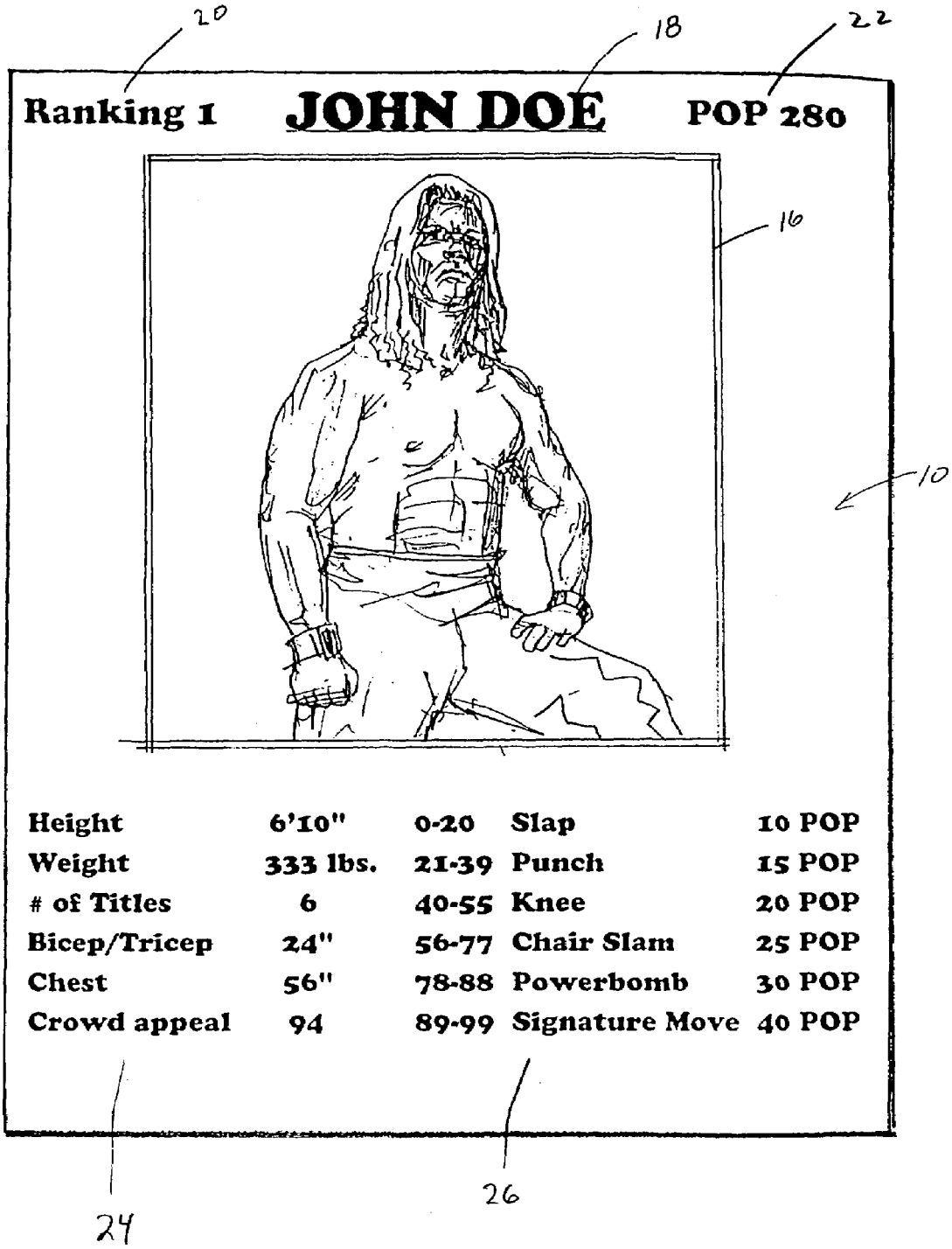
FIGS. 1 to 3 are views of various examples of playing cards showing the face sides thereof.
Figure 2:
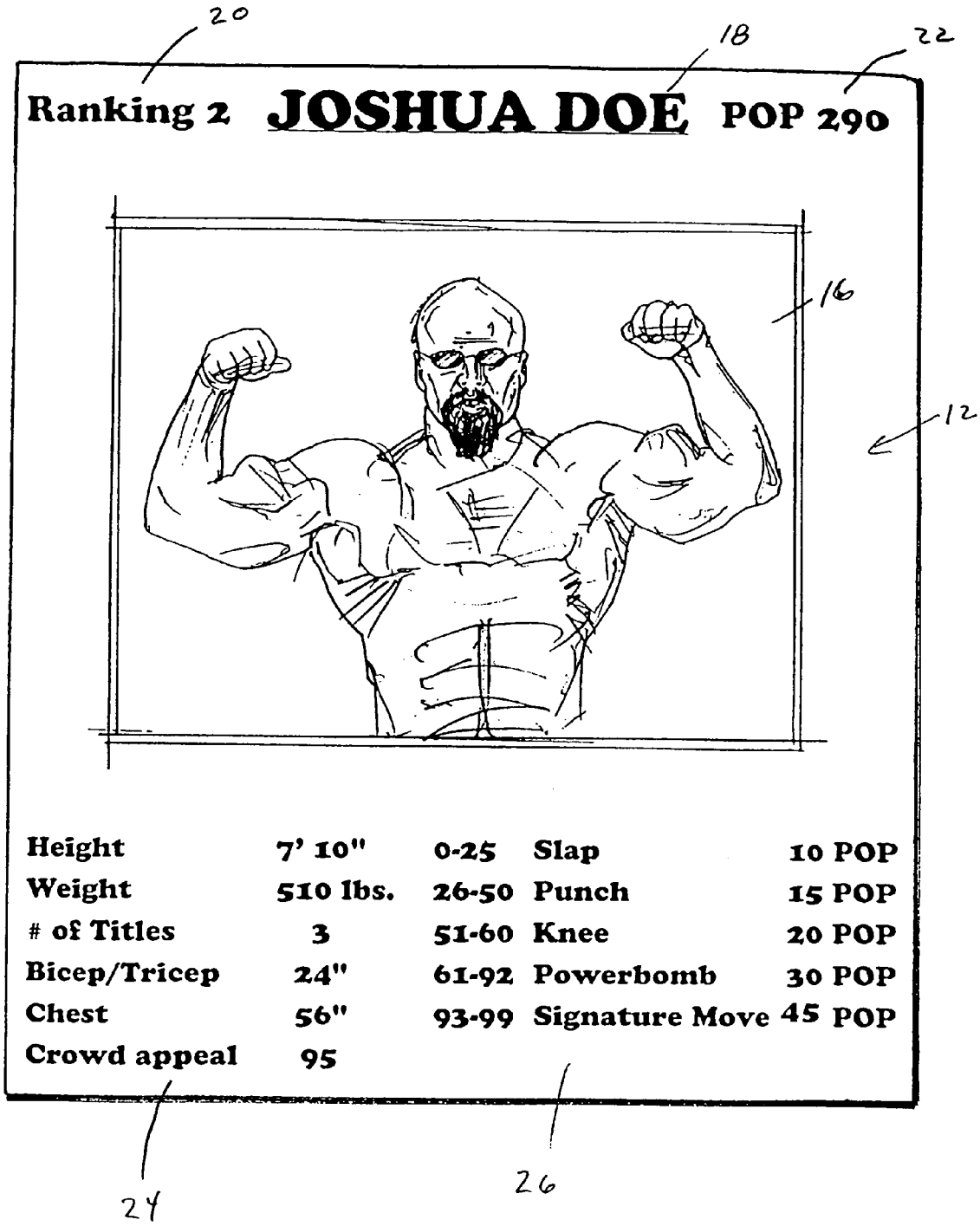
Figure 3:
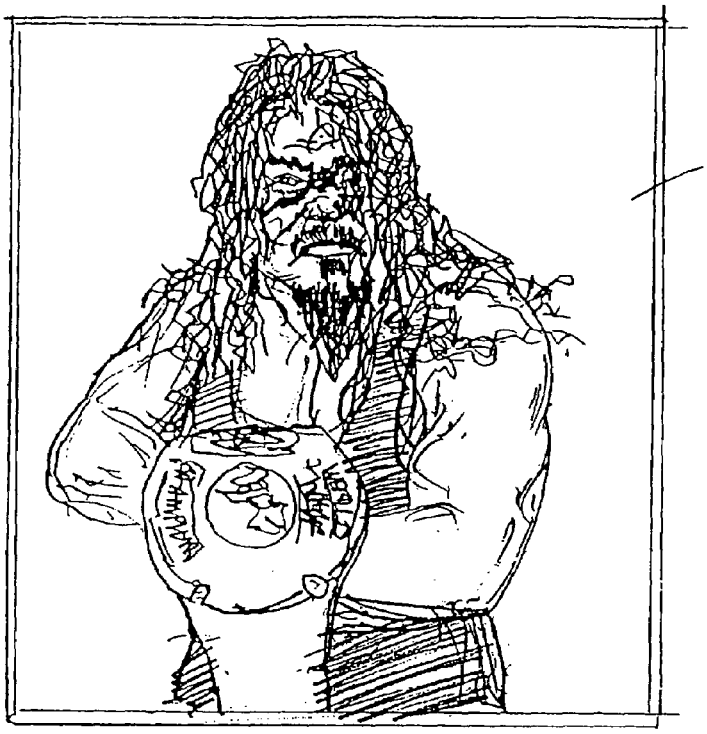

With particular reference to FIGS. 1-3, three different exemplary cards are illustrated and generally designated by the numerals 10, 12 and 14, respectively. Each of the cards 10, 12 and 14 has an image 16 of a respective wrestler thereon. The wrestler's image 16 could be a photograph or a drawing as desired.

The cards 10, 12 and 14 have various indicia thereon used in playing card games simulating a wrestling match. Centered directly above the wrestler's image 16 on each of these exemplary cards is textual indicia 18, for example the name of the wrestler. One skilled in the art will appreciate that the image 16, textual indicia 18, and any other markings thereon may be placed in any location thereof and is not limited to cards and may be an electronic image in a computer simulation of the game. On these cards 10, 12 and 14, the textual indicia 18 is the name of the wrestler represented thereon, for example John Doe, Joshua Doe and Joey Doe, respectively. The following is an example of a layout of the cards 10, 12, and 14. To the left of the wrestler's name 18 is the wrestler's ranking 20 and to the right of the name is the wrestler's total Points of Pain ("POP") 22, which represents the wrestler's overall ability to accept pain from punishment from his opponent. Below the wrestler's image 16 on the left side of each card 10, 12 and 14 is a chart 24 of statistics about the wrestler. These statistics can include, but are not limited to, height, weight, number of titles, bicep/tricep measurement, chest size and crowd appeal. On the right side of each card 10, 12, 14 below the wrestler's image 16 is a chart 26 of different wrestling moves or maneuvers the wrestler can employ during the course of a wrestling match and the amount of POP or "Points of Pain" each move will inflict on his opponent. This set of moves represents a wrestler's personal arsenal. This chart 26 may also include a numerical range associated with each move. For example, card 10 indicates that the "slap" move has a range of 0-20 and a POP of 10. The purpose and meaning of the various indicia on the cards 10, 12 and 14 will become clear upon further explanation of the method of use of the cards 10, 12 and 14 as provided hereinafter. It should be noted that the wrestler's ranking, total POP, crowd appeal and POP that each move will inflict are assigned to each depicted wrestler arbitrarily by the manufacturer of the card. The remaining statistics on each of the wrestlers could also be arbitrarily created by the manufacturer if the wrestlers are fictional but also can be based on the statistics of actual wrestlers. Alternatively, the remaining statistics may bear a predetermined relationship to a character or one or more characteristics of the character such as the image 16 or textual indicia 18 thereof.

Cards 10, 12, and 14 are presented as suitable examples of cards according to this invention. The location and appearance of each indicia on the cards may be varied. Further, the numerical range and/or the POP value for a given move may vary from one card to another. For example, card 14 has a numerical range for the "slap" move of 9-23 and a POP of 15. As mentioned above, card 10, which also has a "slap" move, has a numerical range of 0-20 and a POP of 10. Card 14 also indicates a variation in which there is no move assigned to the numerical range 0-8, which in this example corresponds to a POP of 0. It should also be noted that the type(s) and number of moves on one card may differ from the type(s) and number of moves on another card. The numerical ranges on cards 10, 12, and 14 have a total range of 0-99. The cards according to this invention may have various total ranges.

The total POP, as well as other indicia, for a given character and/or object represented on a card of the present invention may be unique to that individual character and/or object such that all cards having that character and/or object thereon will have the same total POP. However, in one variation the total POP or other indicia may be different on one card having a given character or object depicted thereon from another card having that same character and/or object depicted thereon. Nevertheless, the total POP on any given card is a fixed value that is unique to that card.

The examples above are one embodiment having wrestlers depicted thereon. However, a wrestler may be substituted by any character and/or object.

Another example of a card according to one embodiment of the present invention is a card that has thereon information that indicates changes or modifications of a value of a given statistic or other indicia of another card. Examples of suitable changes include, but are not limited to, increasing the POP value of a wrestling move used by a player, decreasing the POP value of a wrestling move used against a player, adding an extra move to a turn, increasing or decreasing the value of a roll of dice, or any combinations thereof. A booster card may have various additional information, such as, but not limited to, a card title, graphical depiction, textual depiction, or any combinations thereof.

Figure 4:
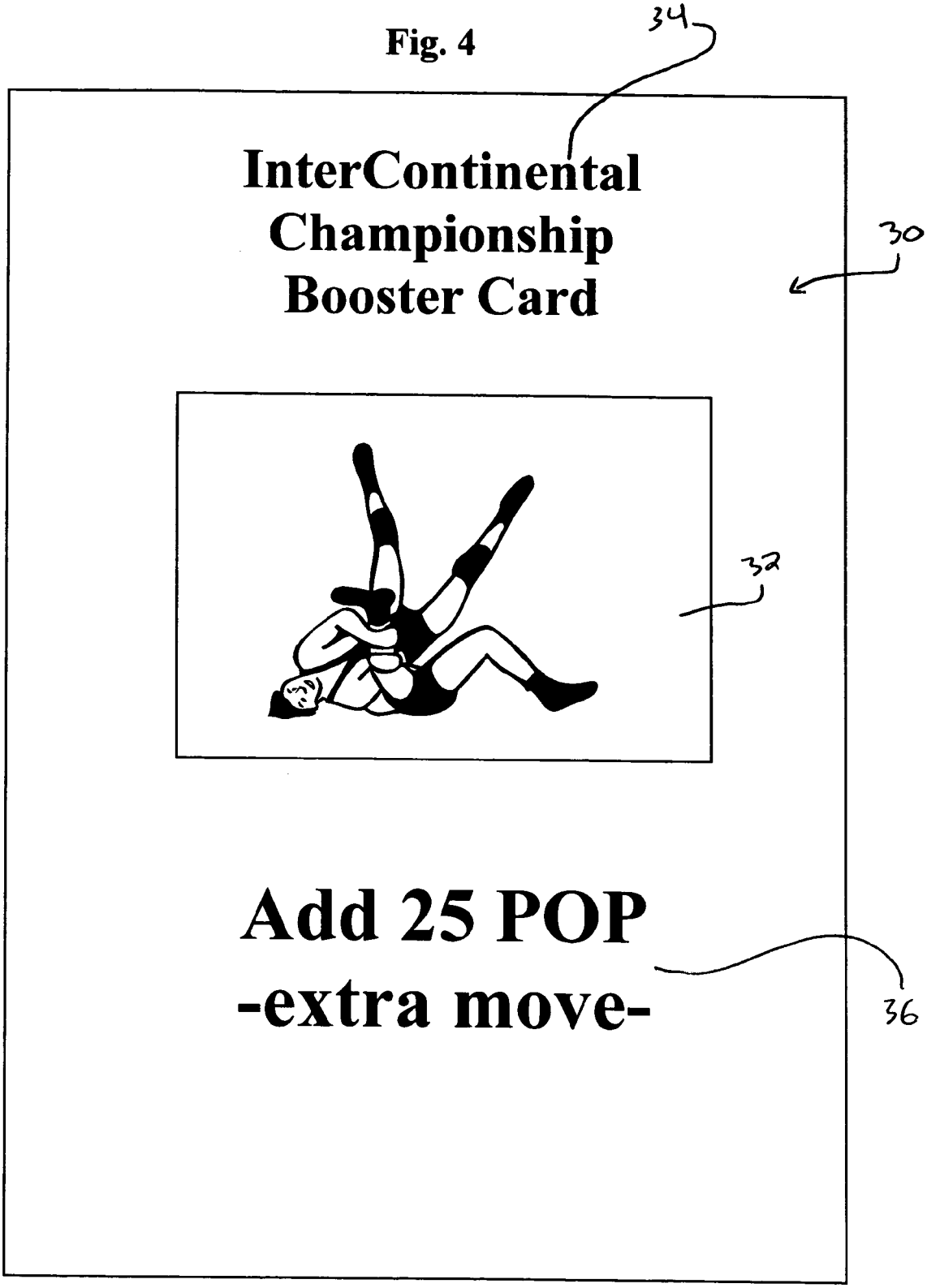
FIG. 4 shows an example of a Booster Card.

FIG. 4 shows an example of a booster card 30. Card 30 has thereon a graphical depiction 32, a title 34, and an indicia indicating a change or modification 36. In the exemplary card 30, the title 34 is Intercontinental Championship Booster Card. The title 34 can be any suitable indication describing the card and may depend on the sport or art of encounterment simulated by the card or cards in the set. Examples of suitable descriptions include, but are not limited to, Lightweight Card, Heavyweight Championship Booster Card, and Cruiserweight Booster Card. In the exemplary card 30, the indicia indicating a change or modification 36 indicates an addition of 25 POP and the modification of giving the player using the card an extra move.

Figure 5:
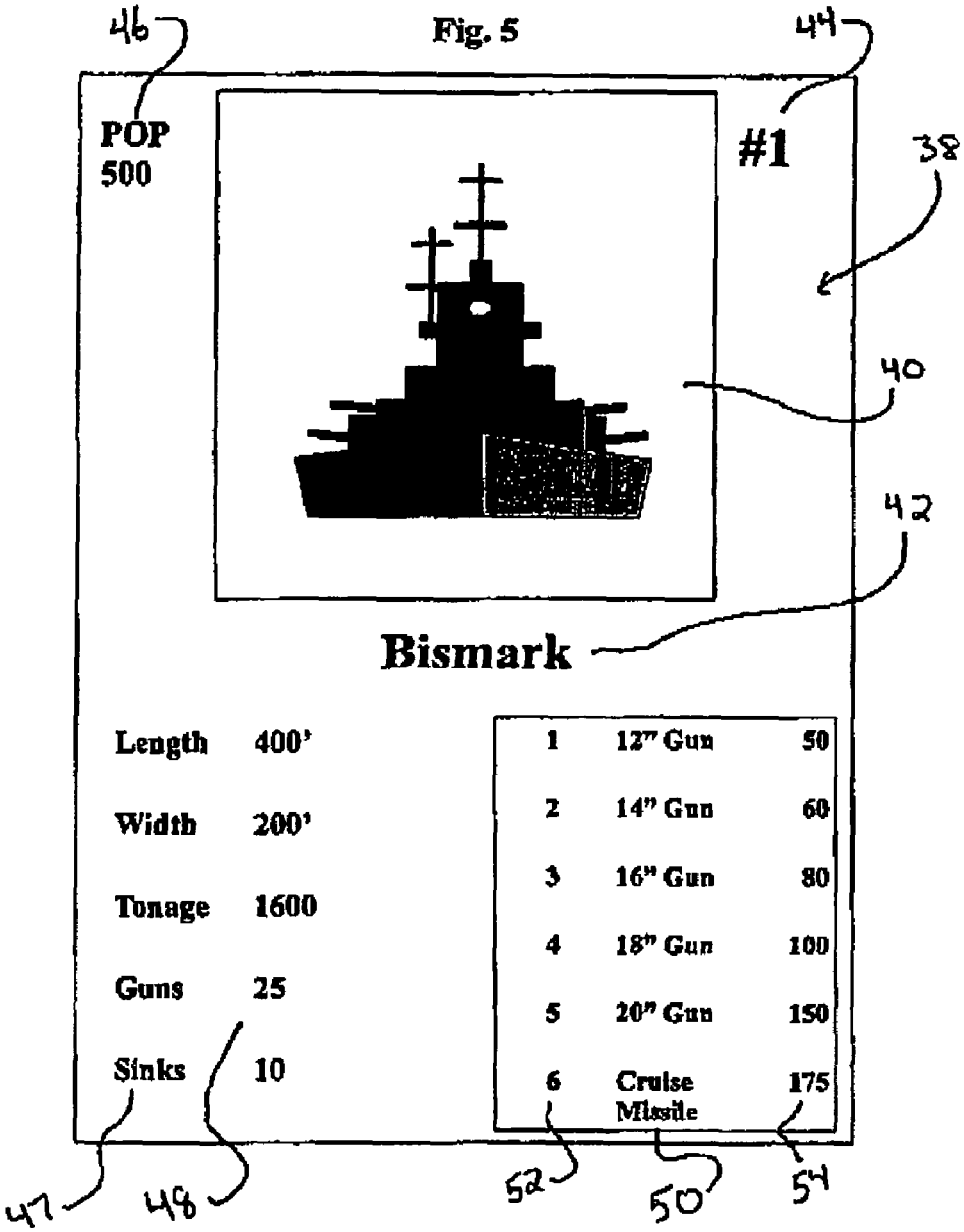
FIG. 5 shows an example of a card having a battleship object thereon.
Figure 5:
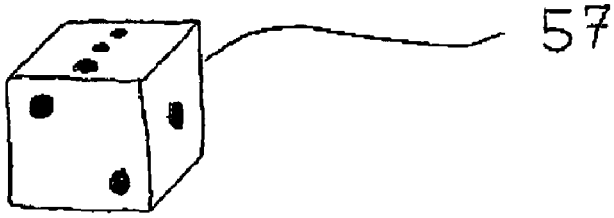
Figure 6:
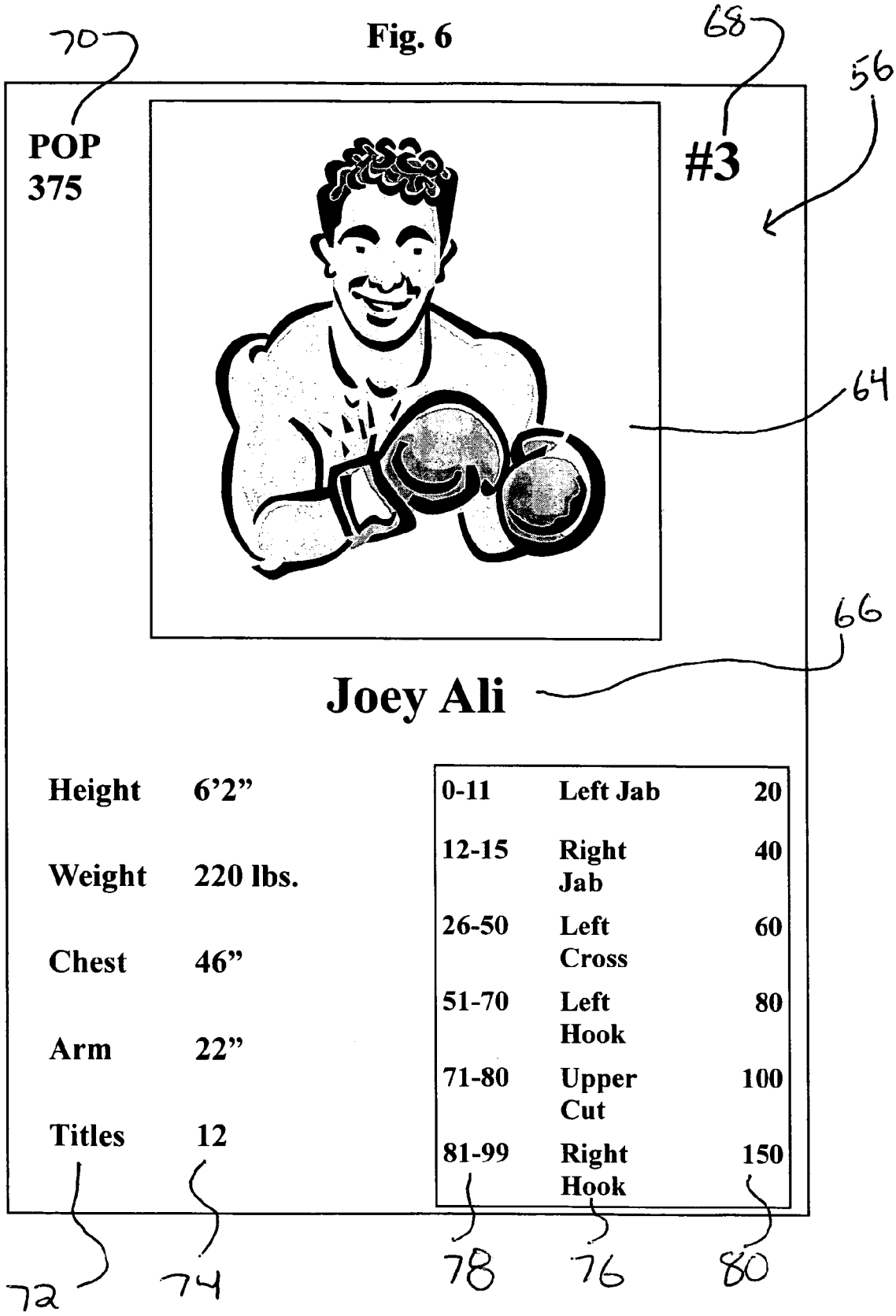
FIG. 6 shows an example of a card having a boxer character thereon.
Figure 7:
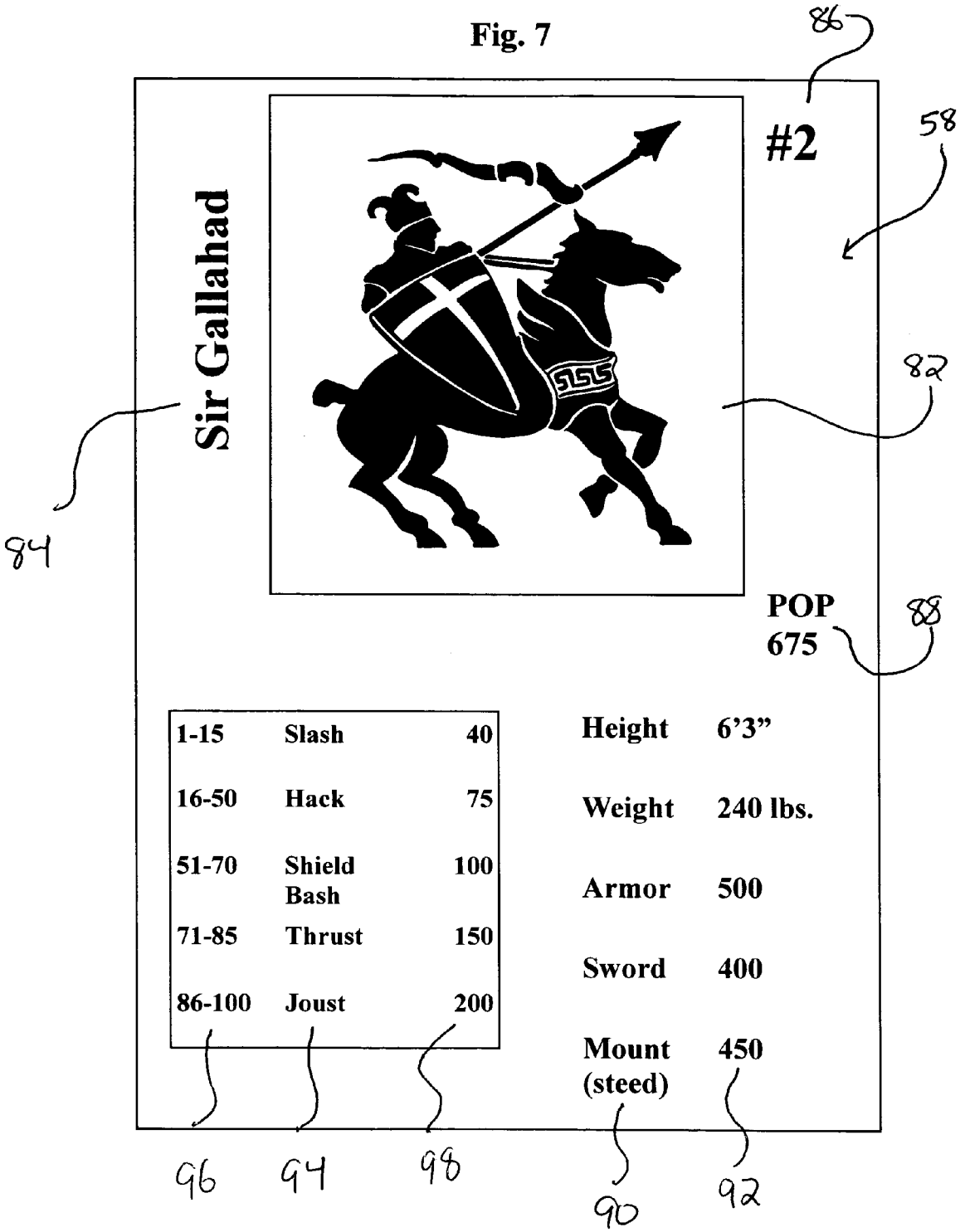
FIG. 7 shows an example of a card having a knight character thereon.
Figure 8:
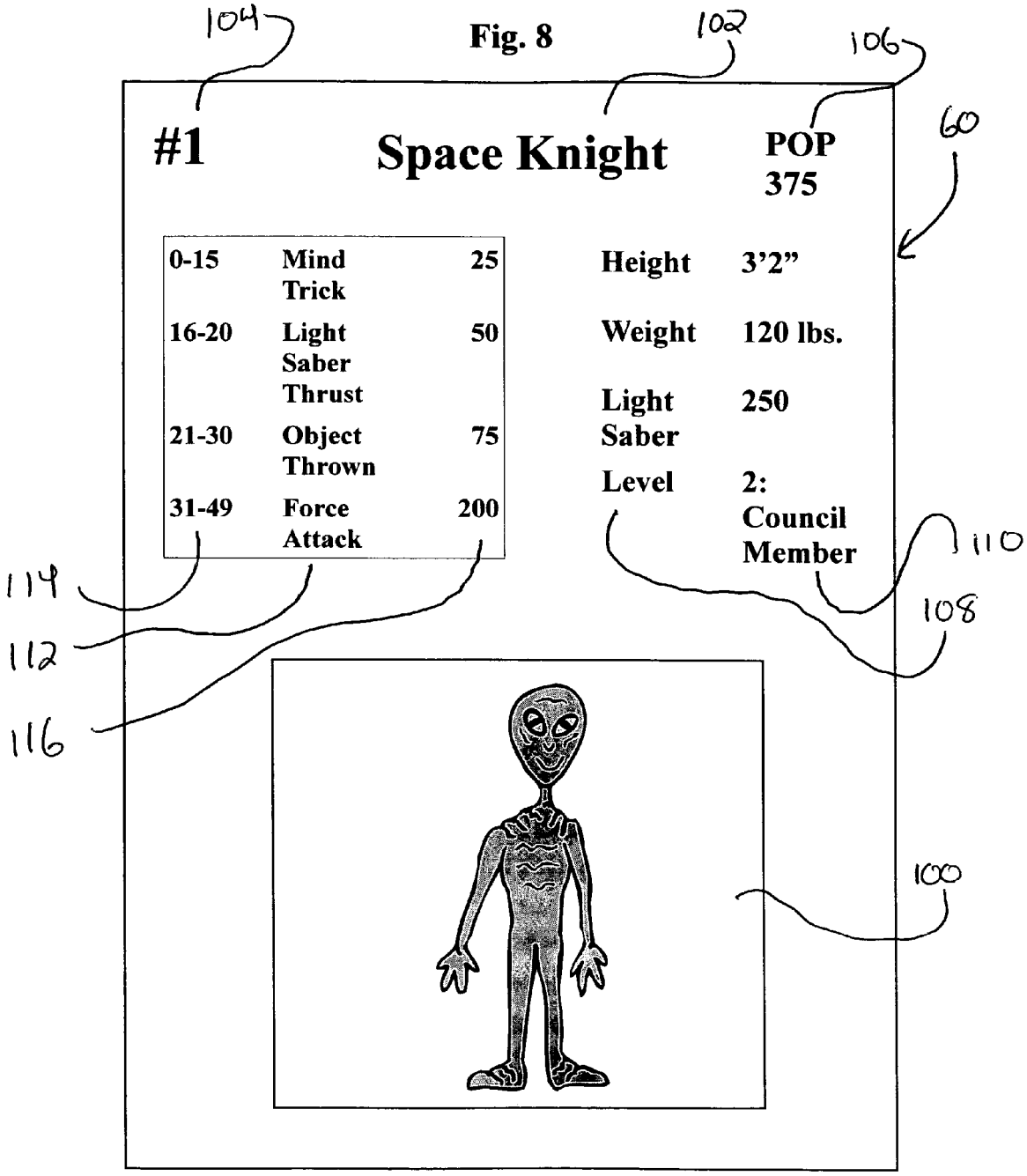
FIG. 8 shows an example of a card having a space knight character thereon.
Figure 9:
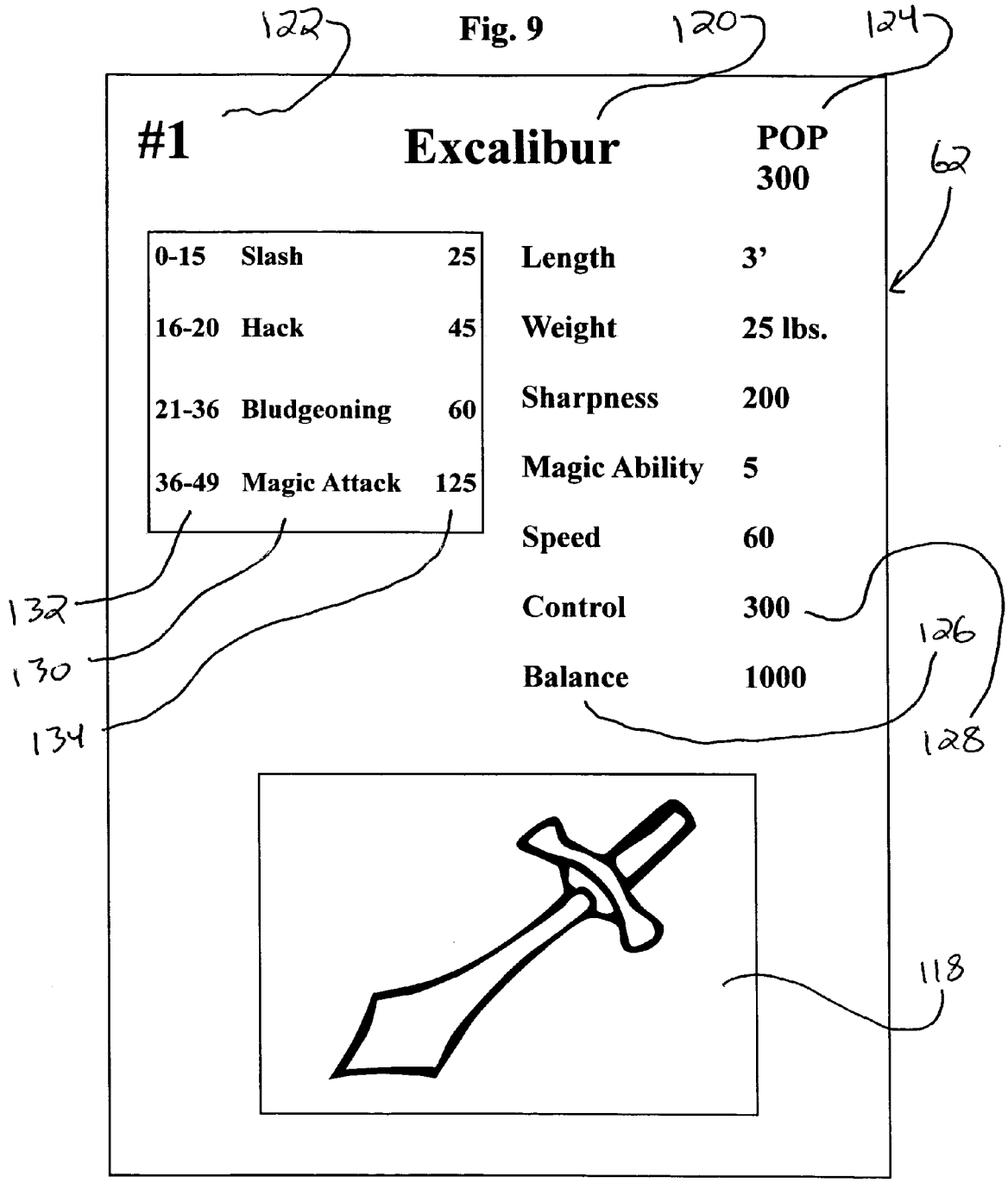
FIG. 9 shows an example of a card having a sword object thereon.

Yet another example of a card 38 according to one embodiment of the present invention is depicted in FIG. 5. Card 38 has thereon a graphical depiction 40 and a textual description 42 of a battleship. Here, the battleship is named the Bismark. Card 38 also has thereon a ranking 44 of the battleship in relation to other objects in the set from which card 38 is taken. Further, card 38 has thereon a rating 46 of the total punishment (total POP) that the object thereon can sustain, categories of statistics 47, statistics 48 of the object, and a number of moves 50 with corresponding numerical ranges 52 and rating of punishment (POP) 54 that each move will inflict on an opponent. The numerical ranges 52 on card 38 show a variation where the total numerical range is 1 to 6. This variation may be accompanied by a single six sided die 57 as a way of selecting a number from the total numerical range. In one aspect, card 38 may be a member of a set of cards with similar and/or different naval vessels or other objects and characters of military engagement thereon. Card 38 shows various gun sizes and cruise missile as moves 50. It should be noted that any suitable category of statistics, statistic, and/or move may be represented thereon. Different cards in the same set may have different moves 50, different numerical ranges 52, and different ratings of punishment 54, as long as the total numerical range for each card in a set is the same in one embodiment. In another embodiment, each card in the same set may be different with different statistics and different ranges, and in another further embodiment the same card may have different ranges. For example, a card in the same set as card 38 depicting a submarine thereon may have additionally or as a substitute a torpedo move and/or a machine gun move, so long as the total numerical range remains the same.

FIGS. 6 to 9 show exemplary cards 56, 58, 60, and 62. Cards 56, 58, 60, and 62 represent various different embodiments of the present disclosure.

Card 56 is one example of a card having thereon a boxing character with a graphical depiction 64, a textual depiction 66, a ranking 68, a rating of the total punishment (total POP) that the object thereon can sustain 70, categories of statistics 72, statistics 74, moves 76, numerical ranges 78, and rating of punishment (POP) that each move will inflict on an opponent 80.

Card 58 is one example of a card having thereon a knight character with a graphical depiction 82, a textual depiction 84, a ranking 86, a rating of the total punishment (total POP) that the object thereon can sustain 88, categories of statistics 90, statistics 92, moves 94, numerical ranges 96, and rating of punishment (POP) that each move will inflict on an opponent 98.

Card 60 is one example of a card having thereon an alien or science fiction character with a graphical depiction 100, a textual depiction 102, a ranking 104, a rating of the total punishment (total POP) that the object thereon can sustain 106, categories of statistics 108, statistics 110, moves 112, numerical ranges 114, and rating of punishment (POP) that each move will inflict on an opponent 116. The numerical ranges 114 of card 60 exemplify a variation in which the total numerical range is 00 to 49. Any suitable way for selecting a number from the total numerical range may be used, such as a die representing each numbers place. In one aspect, one five (5) sided die having numbers 0 to 4 thereon and one 10 sided die having numbers 0 to 9 thereon may also be provided.

Card 62 is one example of a card having thereon an object with a graphical depiction 118, a textual depiction 120, a ranking 122, a rating of the total punishment (total POP) that the object thereon can sustain 124, categories of statistics 126, statistics 128, moves 130, numerical ranges 132, and rating of punishment (POP) that each move will inflict on an opponent 134.

Each of cards 56, 58, 60, and 62 may be used with other cards having thereon similar and/or different characters and objects thereon. Any suitable moves may be substituted for those moves indicated thereon. The specific location of indicia on the card may be varied. Cards 56, 58, 60, and 62 show various exemplary placements of the indicia thereon.

Having described the cards, various methods of using cards such as cards 10, 12, 14, 30, 38, 56, 58, 60, and 62 will now be explained. Although only nine cards are shown in the drawings, it should be understood that any number, from two to infinity, of such cards could be made to produce a set of cards. Each card in a set of cards could depict a different character or object. However, a set of cards may also have one or more of the same cards and/or cards having the same character or object with other different indicia thereon.

A player may obtain a set of cards in any suitable way. Examples of suitable ways to obtain cards include purchasing individual cards, purchasing sets of cards, winning cards in previous engagements, or any combinations thereof. Thus, a player's set of cards may vary in number and variety over time as the player obtains and loses cards. Some cards may be more rare than others and therefore more difficult to obtain.

For the following described games, the object is to defeat your opponent(s) and/or gain his/their card(s). Each player may supply his own cards to be used in play. Prior to or during initial stages of play, it is determined, preferably by mutual consent of the players, which game from the various games depicted on the cards will be selected for game play.

Players may decide amongst themselves prior to play, a fair method for determining which player will go first, what the order of play shall be thereafter, how ties will be broken, how many cards each player will use during a match or set of matches, method of selecting a card to be placed in play, whether high values or low values will prevail (be the "winning" value), and/or any other rules or variations that they wish to employ. Examples of suitable methods for determining which player will go first include, but are not limited to, rolling a die or dice, flipping a coin, highest or lowest ranking of a random card, and highest or lowest total rating of punishment of a random card. When the cards are used to choose, there is a variation in which more than one card can be used as a team and the total or average value of the indicia of that team is compared to a team of an opponent's cards. Examples of suitable methods of determining order of play include, but are not limited to, clockwise, counterclockwise, winner of previous turn goes next, and loser of previous turn goes next. Examples of suitable tie breaking methods are discussed in detail below. Examples of suitable methods of placing a card in play include, but are not limited to, randomly selecting a card from a predetermined group of cards, strategically selecting a card from a predetermined group of cards, placing a group of cards in a stack either randomly or strategically and selecting the top, bottom or other card from the stack, and flipping cards.

Cards that are won by a prevailing player may be dealt with in a variety of ways. In one example, cards that are won may be used again by the winner if all players choose to keep playing after all the cards in their original stacks have been used. In another example, cards that are won may be randomly placed back into the winner's set of cards. In another embodiment, one with a highest number of cards in a winner's pile will retain, not only his own winner's pile, but also the remaining player's winner's piles.

Another variation that can be used no matter how many players are involved in play is to start with an equal number of cards in each player's stack or hand. The won cards are to be placed aside into a winner's pile for that round. When the player's stacks have been exhausted, the player with the most cards in his/her winner's pile wins all cards from all winner's piles.

In yet another variation, players can select one or more cards prior to game play to represent a bonus to the winning player. The one or more bonus cards may be selected randomly or strategically by each player or by an opposing player. The one or more bonus cards may be placed aside until the end of game play and awarded to the winner at the end of game play or at an interval predetermined by the players.

Wrestler's Statistical Series:

One method of using the cards is the Wrestler's Statistical Series in which the object of the game is to gain the opponent's cards by comparing statistics between or amongst cards. Each player chooses a card or cards from their own set of cards or from a mutually agreed upon set of cards to use for a given match. In one embodiment, each player may hold their cards with the statistics of their card facing themselves, and in such a manner so that at the same time the player's opponent(s) cannot see their card's statistics. In another embodiment, each player may arrange their cards in a stack face down. The players decide prior to play which method of these and others to use. Each player selects a card for a first comparison using a predetermined method of selection. The first player (Player A), as previously determined, picks a statistical category from the chosen card. The picking of a statistical category may be done after viewing the face of the card or prior to viewing the face of the card. This statistical category may be chosen from the statistical categories listed in chart 24. These statistical categories may include, but are not limited to, height, weight, number of titles, bicep/tricep or arm measurement, chest measurement, a rating of the wrestler's crowd appeal, or any combinations thereof. Alternatively, the picking of the statistical category may be done in any number of ways known in the art and the method is not limited to any predetermined way. The picking may be done in a manner such as the player choosing a category, the rolling of any die, an agreement of all the players, a random selection, an electronic selection, program instructions on a recordable medium or any combinations thereof. Strategically, the player may choose a category in which the wrestler depicted on their card has an advantage over the card of the opponent(s) wrestler.

Player A may then orally or otherwise indicate the statistical group chosen. The players then compare the values of the chosen statistical category from each of the cards in play. The winner, the player with the card having either the highest or lowest statistical value as previously determined, retains all cards in play. For example, if Player A's top card was card 10 (i.e. John Doe), he might choose Height as his category as John Doe's height is six feet, ten inches (6' 10"). If Player B then had card 14, (i.e. Joey Doe), who is only six foot, two inches (6' 2"), then Player A would win the round and both cards. If, however, Player B had card 12, which is the seven foot, two inches (7' 2") Joshua Doe, then Player B would win the round and both cards. Play then continues with the next person in the order of play choosing a statistical category and so forth. Play may continue until all the cards in the stack are played and the player with the most cards wins the game, or until one player has won all the cards, or until a point agreed upon by the players. It should be noted that, if desired, before play starts, players can be allowed to position their cards in their stack to achieve a maximum advantage, and that the players do not have to start with the same number of cards.

A tie may occur when two or more cards in play in a given round have the same statistical value in the called statistical category. A tie may be broken in various ways. A method for breaking ties should be agreed upon by the players prior to play. A tie generally only matters if the two or more cards with the same value have the "winning" value, for example if the highest statistical value is decided to prevail, a tie between two cards of a lower value than a third card in play would be irrelevant.

If a tie occurs between the cards of Player A and Player B, an example of a method of breaking a tie would be to have Player A choose another category from the same card for comparison to that of Player B's card. The player with the "winning" value would prevail and thus keep the cards of Player A, Player B and any other players whose cards were not part of the tie. If Player A and Player B have identical cards, this method will not break the tie. One example of a method to deal with identical cards in a tie is to have the tying players agree to put their cards back in their stacks in a random place, or to leave those cards to be won by the next round's winner, or have the players agree upon another tie breaking method.

Another example of a method of breaking a tie would be to have Player A choose another category from a different card, such as the next card in Player A's stack or hand, for comparison to that of Player B's original card. Another variation on this method would be for Player B to also choose a different card for comparison.

Still another example of a method of breaking a tie would be to have Player B call out "Reversal." In a Reversal Player B may choose a different category from the same card to be compared against Player A's same card. A variation on this method would be to have Player B choose a different category from a different card, such as the next card in Player B's stack or hand, for comparison to that of Player A's original card. Another variation on this method would be for Player A to also choose a different card for comparison. The winner of the 'reversal' comparison wins the round and all cards in play.

When three or more players tie, the rules of play and tie breaking are similar. The order of the right to call a Reversal may go in the same order of play previously determined for game play. In one example in which the order of play is determined by clockwise direction, the order goes in a clockwise direction from the player who has won the original category statistical to call. The first player involved in the tie from (the first player to the left of the original caller involved in the tie) is the player to call "Reversal" and chose the new category. Then play continues as usual.

Still yet another example of a method of breaking a tie would be to compare another indicia from the tying cards in play. For example, the comparison may be between or amongst the ranking of the tying cards or the total POP value.

Methods of breaking a tie may be combined or repeated until a tie is broken.

If three or more people choose to play, then all the rules remain the same except in the case of ties. In the case of a tie, only those players whose cards are tied continue, the loser(s) forfeit their card(s), and those cards become part of the eventual winner's purse. Also note that the tie must be the best statistic, if not the tie does not matter. The cards are won by the player with the best statistic. For example, two players have card 10 (i.e. John Doe), and one player has card 12 (i.e. Joshua Doe), and the category being called is Height. The player with card 12 wins the round and all the cards played in that round. The tie of the lower height statistic of card 10 does not matter.

Flip-Off:

Another method of using the cards is Flip-Off, which can be played between two or more players. If two players are playing, each of the players may begin with as many cards as he wishes to play face up in his stack so that both players know which card is being played by both players in each round. Cards may also be kept face down until flipped, so long as when the cards are flipped they are flipped in such a manner as to allow identification of which card belongs to which player. A match begins with two players standing opposite and facing each other, each holding one of his cards by the edge(s). The players then release their cards by allowing their cards to tumble end-over-end to the floor. The winner of the round is the player whose card lands face up. If both cards land face up, the wrestler's ranking determines the winner. The higher ranking (i.e. the lower number) wins the round and both cards. The wrestler's ranking is found in the upper left hand corner of each card. For example, if Player A's card was card 12 (i.e. Joshua Doe) who has Ranking 2 and Player B then had card 14 (i.e. Joey Doe) who has Ranking 3, then Player A would win the round and both cards. If, however, Player B had card 10 (i.e. John Doe) with Ranking 1, then Player B would win the round and both cards. In some instances, the players might be using the card of the same wrestler, so the players must be watchful of which cards are theirs during Flip-Off. If both cards land face up and have the same Ranking, then the players can either leave those cards in the "ring" for the winner of the next round, or they can re-flip the original cards that were involved in the tie. If both cards land face down, the players can either flip again or leave those cards for the winner of the next round. The methods of play should be determined before play begins. Play continues until all the cards from the original stacks have been used, or until one player wins all the cards, or until the players agree to cease play. The duration of play should be agreed upon before play begins. In another alternative embodiment with two or more players when playing flip off, the method has the steps of determining a winner by a first card facing down over another second card facing up after flipping. The first card facing down on top of the second card wins by simulating "a wrestling pin move". Alternatively, the winner with two player play may be determined vice versa with the first card facing up and the second card facing down.

When three or more players want to compete, there are several variations of play. In a first variation, each player whose card lands face down loses and forfeits his card. If only one player's card lands face up, he wins all of the cards. Otherwise, the players whose cards have landed face up re-flip their cards. This process continues to eliminate players until there is only one player left. That player is the winner of the round and all the cards played in that round. In the second variation, the winner is the player whose card does not match the other players. So, if there are three players and upon flipping their cards, two cards are face down and one card is face up, the player with the face up card wins the round and all the cards played in that round. Likewise, if two cards are face up and one card is face down, the face down card wins the round and all the cards played in that round. If all the players cards land face down in the original round, the players can either re-flip the same cards, or leave those cards in the "ring" for the winner of the next round. The winner of that new round wins all the cards that are at stake. If all the cards land face up, then the players can either re-flip or use the Ranking to determine the winner of the round. The method of play should be determined before play begins. If the Ranking method is used the player with the highest ranking or lowest number wins the round and all the cards played in that round. If a tie exists for the highest ranking, a method of breaking the tie would be to have those players who have tied either re-flip the same cards or flip new cards. The winner is to be determined by reverting back to the original methods of play. For example, if two players are left after a tie, then the card that lands face up is the winner of the round and all the cards. If both land face up, then re-flip or use rankings, etc. Again, the method of play should be determined before any play begins. Play may be over when all the players agree to end the game, or one player runs out of cards, or one player wins all the cards. The method for duration of play should be determined before play begins.

Another example of a variation in play would be to compare another indicia from the cards of each player. For example, instead of comparing the ranking, the comparison step could include the comparison of rating of total amount of punishment that the specific character or object represented thereon can sustain or the rating of punishment of a predetermined individual move, such as the signature move.

Another example of a variation in play would be to have any card that lands face down on top of another card would be deemed a prevailing card over that card. This would be considered a "pin". The "pin" may be used as a method of breaking a tie or in a situation where all cards land face down.

Still another example of a variation in play is that should a player run out of cards during a round, he may borrow cards from any other player or person who has a card and is willing to lend him a card. The player loaning the card(s) may be repaid should the player he is backing wins. That repayment may be the card(s) the loaner gave the borrower as well as a one card interest payment. The repayment may be chosen by the loaner. If the player who borrows the card(s) loses, then the player who lent him the cards also loses. If no cards are lent to the cardless player, then all cards for that round are returned to their original owners. Also, the card lent to the cardless player cannot be known by anyone. It may be picked at random from the loaner's hand who has his cards face down. The method of this variation should be determined prior to play. The card lending variation may be part of any game of the present invention in which it is possible to run out of cards.

In a four or more player variation, teams having an equal number of players on each team may be chosen. Whichever team has all of their cards land in the same direction (face up/face down), while their opponents' cards do not—wins the round and all the cards in that round. If there is not a winner, the cards can either be re-flipped or left in the ring to be won or lost in the next round.

It should be noted that in addition to comparing the ranking value during a Flip-off, other indicia may be compared. For example, other statistical values, total POP values, and/or POP of wrestling moves may be compared using a Flip-off method.

Wrestler's Duel:

Another method of use for the cards is called Wrestler's Duel. When play is between two players, each player should start with the same number of cards in their stacks, but this is not a necessity. The player places his stack face down in front of him so that no one can see the face of his cards, including the player himself. The cards can be initially arranged by the players, but cannot be rearranged once play has started. In this game, the players flip over their cards one-at-a-time from the top of their personal stacks revealing the ranking of their wrestler. The wrestler's ranking is found in the upper left hand corner of each card. The player with the card depicting the wrestler having the highest ranking (i.e. meaning lowest number) wins and captures his opponent's card. In a variation, the player with the card depicting the wrestler having the lowest ranking (i.e. meaning the highest number) could win the opponent's card. In the case of a tie, the players can either take back their cards and return them into their original, personal stacks in a random place or leave them in the ring to be won or lost in the next round. The game can end in a variety of ways determined by the players prior to the commencement of play. One example of how to end the game includes placing cards in a pile next to the winner as the cards are won. After the original, personal stacks have been used, the player with the most cards in his winner's pile wins all the cards in both winner's piles. In the event that both winner's piles have the same number of cards, each player can either choose one card at random and have a duel for all the cards by comparing the rankings on the chosen cards or the players can keep the cards in their winner's pile.

In another variation the players can continue to play from the winner's pile after their original, personal stacks have been exhausted.

Another example of how to end the game includes having the players continue play until one player wins all the cards. Yet another example of how to end the game includes having the players cease play after a certain agreed upon period of time. Still yet another example of how to end the game includes having all players mutually agree to end the game at the time of agreement. Again, the desired method for the ending of play should be agreed to before play begins.

In a Tag Team variation of the previously explained two player version, if there is a tie, the original cards are left in the ring, then one or more additional cards (the number of additional cards to be placed into play being predetermined by the players) is put into the ring face down or face up by each player, and then a third card is flipped face up by each player. The rankings on the first, the second, the third or any number of card are compared, thus determining the "King of the Ring" or the winner of all the cards in the ring. If another tie occurs, the procedure is repeated until a winner is determined. If a player runs out of cards during the play of a tie, the cards in the ring are returned to their original owners or cards may be borrowed or loaned amongst players to continue play.

For three or more players single or Tag Team play can be used, the play is the same as with two players being that the player with the highest ranking (i.e. lowest number) wrestler wins and takes the cards played by the other players. In case of a tie, only the players involved in the tie and with the highest ranking continue to play additional cards to win all the cards in that round. Cards played after the tie in order to break the tie may also be won by the winner or replaced in each player's stack with the winner only taking the original cards played.

Wrestler's Match:

Another method of using the cards is known as the Wrestler's Match. It can be played by two or more players. Each player plays with one card at-a-time in single match play, and two or more cards per match in "tag team" play. The entire match may be played with this one or more chosen cards. In single match play, it is possible to play the entire match with only one card for each player. The players may predetermine how many matches will be played overall before actual play begins and therefore choose the appropriate number of cards to use for playing the game. Preferably, the cards are not initially revealed to the other players. In addition to the cards, each player may receive a way for selecting a number from the total numerical range depicted for the moves in chart 26 of a card. Suitable ways for selecting a number will be capable of selecting a number from within the total numerical range on a card. For example, card 14 has a total numerical range of 0 to 99. The way for selecting a number should permit selecting any number from 0 to 99. If the total numerical range represented on the card or cards were 1 to 6, a suitable way for selecting a number would be capable of selecting a number from 1 to 6, such as a conventional 6 sided die. In another embodiment, the range may be determined by a number of moves on the card and the range may be determined such as for example six moves on the card uses a six sided die and alternatively ten moves on the card uses a ten side die. One skilled in the art should appreciate that ranges are not limited to this embodiment. Examples of a suitable way for selecting a number include, but are not limited to, a die or dice, electronic device, computer, or any combinations thereof. In one embodiment, the players may use a pair of ten-sided dice with the numbers of 0 through 9 thereon. When two dice are used, each die should be a different color, for example one black die and one yellow die. Another way for selecting a number from the total numerical range is to have the player whose turn it is choose a number prior to viewing the card that they will put into play.

A suitable way for scorekeeping or keeping track of diminishing Total POP of each round as the match progresses may also be provided. Examples of suitable ways for scorekeeping include, but are not limited to, a scoring pad and a writing instrument, or a calculator. An electronic version of playing the games of the present invention may have a way for scorekeeping associated with the electronic version of play.

A playing surface may also be provided. A suitable playing surface may be a table top, the ground, a floor, a sheet of paper, vinyl, cardboard, wood, plastic, or other material, or any combinations thereof. The playing surface may have one or more square boxes thereon. The boxes may be arranged anywhere inside the playing surface. In one embodiment, the playing surface may represent the "ring" in which game play may commence.

Each player chooses the card he wishes to use from his personal stack or hand that is to be played in the round, or multiple cards in Tag Team play. Preferably, the cards are chosen without revealing them to the other player(s). When the match begins, each player may throw the card(s) he has chosen into the ring simultaneously or in a predetermined order of play. Other methods of displaying the chosen card to the other players include, but are not limited to, placing the card on the table, a Flip-off as described above, or any combinations thereof. At this time, all players will now know their opponent's card(s). In a variation, players may place one or more cards face down revealing only each card put into play one at a time.

On the face of each card, for example in the upper right hand corner, next to the wrestler's name, is each wrestler's total POP rating. These ratings may be arbitrarily assigned but portray the wrestler's overall ability to accept pain from the punishment he will receive from his opponent's successful attacks. In other words, it is the total amount of pain that the wrestler can absorb from his opponent(s) before he loses the match, or is considered out of play. When a wrestler's total POP rating is reduced to zero or less (a negative number is arrived at after deducting the POP of an attacking wrestler's move from the total POP rating of the attacked wrestler) during game play, the wrestler is subdued, pinned, and/or defeated. The wrestler with a zero or less rating does not get a counter attack. The match is over and the other player wins the match and all the cards used in the match. Each card may have in the lower right hand corner, or other location, a chart of different moves that the wrestler can employ on his opponent. The moves represent the type of maneuvers that a wrestler can perform in the ring to defeat his opponent. The move the wrestler employs also correlates to the amount of punishment or POP that the move will inflict on any opponent. The moves run from the typical slaps, punches, or kneeings to the exotic aerials, piledrivers, powerbombs, chair slams, table crunches, as well as each wrestler's signature move. Suitable moves are well known to those skilled in the art. Each wrestler moves in a given set of cards fall within the same total numerical range, for example a range of 0 to 99, although each wrestler has different moves and ranges within the overall range and/or different POP damage for the same move. Again, the different moves and ranges represent the strengths and weaknesses of the wrestler.

One method of choosing the player that will begin play has each player throw one die and the player with the highest number begins play. An obvious variation would be to have the player with the lowest number or a predetermined number begin play. Other methods of choosing the player that will begin play are discussed above. When the way for selecting a number from the total numerical range is two die, each player may designate, preferably before play begins, which of his die will represent the first number of all his throws and which die will represent the second. For example, when the total numerical range is 0 to 99 and two ten-sided dice each with 0 through 9 thereon is used, one die may be designated to the tens place and the other die designated to the ones place, such that rolling both dice will result in a number from 0 to 99. In another variation, the total numerical range may be 1 to 100, where a roll of 0 on each die would represent 100.

Alternating throws of the dice amongst players plays the game. The order of play should be predetermined. Each throw of the dice indicates a number between 0 and 99, which corresponds to a wrestling move that the player's wrestler makes on his opponent. The corresponding number of POP from the chart on the player's card is then subtracted from the opponent's total POP. The first player who depletes the wrestler's total POP of his opponent is the winner. For example, assume Player A's card was card 10 (i.e. John Doe) and Player B had card 12 (i.e. Joshua Doe). Player A on his first roll of the dice rolls a 60. Thus, the equivalent wrestling move to a 60 roll for John Doe is the 'Chair Slam' (range 56-77) with a POP rating 25 as read off the POP chart 26 on card 10. On the score pad, the POP rating of 25 is subtracted from Joshua Doe's total POP rating of 290, leaving him with 265 POP left. The players would then alternate rolling their dice or other way of selecting a number from the total numerical range until the POP ratings from the moves based on the rolls of Player A meets or exceeds Joshua Doe's total POP rating of 290, or the POP ratings of the moves based on Player B's rolls meets or exceeds John Doe's total POP rating of 280. The player who first meets or exceeds his opponent's total POP rating wins the match and the cards.

A variation of play could be if a player rolls doubles (i.e. both dice have the same number), then that player gets another roll. If doubles is achieved a second time in a row, the POP rating for the move may be doubled and deducted from the total POP of the opponent.

In Tag Team play, play is conducted as in singles play, but instead two or more cards of each player are selected and put into play. For example, the cards may be laid face up in the ring for play or one card face up with the others face down. Each player chooses the card, which is going to be played first preferably before seeing his opponent's cards. To bring the other card into play (i.e. "tag" the wrestling partner), the player forfeits his roll at the time of the tag. A player can "tag" as often as desired. A variation on Tag Team play is, after a roll is forfeited to bring the other card into play, 20 POP (or any number agreed upon between players before play begins) are added to the total POP remaining for the wrestler leaving the ring to represent the "rest" he received while not wrestling. One example of a method for determining the amount of POP added during a "rest" is to roll a die or dice to represent the amount of POP to be added. The players involved in the match should agree upon a method for ending game play before play begins. One example of a method for ending play is when one of the wrestlers of the team has a remaining total POP rating of zero or less. He is considered 'pinned' and the match is over. The other player (who does not have any of his wrestlers having a total POP rating of zero or less) wins the match and all the cards. Another example of a method for ending play is a wrestler is considered 'knocked out' when his remaining total POP rating is zero or less. He does not regain any POP and never returns to play in that match. However, the second wrestler of the 'tag team' is still in play. It is only when both wrestlers of one team have a remaining total POP rating of zero or less that the match is over and the winner is determined. The winner wins the match and all the cards used in that match.

In one aspect of "Tag Team" play, total POP is not traded or moved from one wrestler to the other wrestler of the 'tag team'. However, a predetermined variation may be to have a certain amount of total POP tradable between members of the "Tag Team". When three or more cards are used for each "Tag Team," the rules of play are the same, except that there are more members of the "Tag Team" to choose from when swapping wrestlers in the ring. When the total POP of all wrestler's on the "Tag Team" is required to be deleted prior to termination of a match, the more cards used on the "Tag Team" would naturally increase the length of match play.

Another variation of "Tag Team" play would be to have more than one card from the team in the ring at a time. In this variation, the way of selecting which card on an attacking team and which card on a team being attacked will be used in a given turn. Suitable methods of selecting the card on either or both the attacking team and the attacked team include, but are not limited to, having the attacking player choose the card from their team, having the attacked player choose the card from their team, having both cards take a turn, having the highest ranked card attack first, having the lowest ranked card attack first, and having one roll apply to both cards. These methods should be determined prior to play.

Another variation of play involves the use of a means for altering play. In this variation, additional cards may be provided that have thereon an indicia that describes a change or modification to play. An example of such a card is a "Booster Card." An example of a "Booster Card" is given in FIG. 4. Booster Cards may have indicia to modify or change the value of an indicia, such as the POP value for a wrestling move or the numerical range assigned to a wrestling move, of another card. Examples of suitable changes include, but are not limited to, increasing the POP value of a single wrestling move or multiple wrestling moves used by a player, decreasing the POP value of a single wrestling move or multiple wrestling moves used against a player, adding an extra move to a turn, increasing or decreasing the value of a roll of dice, adding or subtracting value from the total POP rating of a wrestler, or any combinations thereof. The use of Booster Cards should be determined prior to play.

One example of how a Booster Card may be used in play includes the Booster Card being played during an attacking player's turn by the attacking player to increase the POP of the wrestling move used. Another example of how a Booster Card may be used in play includes the Booster Card being played by an attacked player to decrease the amount of POP of the attacking player's move. Certain Booster Cards will affect single turns, while other Booster Cards may affect a range of turns or the entire match. Other Booster Cards may add or subtract value from the way or means for selecting a number from the total numerical range, thus possibly changing the move chosen. For example, a Booster Card that decreases the value of a roll of dice by 20 would change a roll of 64 to 44 and would change the outcome move for the example card 10 from a "Chair Slam" to a "Knee" move. Whether Booster Cards are put into play prior to a selecting of the number from the total numerical range or after the selecting is preferably determined prior to play.

If three or more people are playing, the rules remain the same. Order of play may be determined by the original roll of one die or by any other suitable method. The order may proceed from highest roll to lowest roll. In the event of a tie on the rolling for order of play, then the players who tied have a roll off to determine the order of those players. For example, there are four players who have rolled for order of play. Player A rolled a 9, Player B rolled a 2, Player C rolled a 4, and Player D rolled a 4. In the roll-off, Player C rolled a 1 and Player D roll a 9. The order of play would be Player A, then Player D, then Player C, then Player B. Player A and Player D are not considered to be tied for order of play because the order had been determined by the original roll. Likewise, Player C is still before Player B because of the original roll for order of play. Other suitable ways for selecting the order of play are discussed above.

When three or more players are playing, the opponent to the attacking player may be chosen by any fair method. Examples of fair methods for selecting an opponent include, but are not limited to, the attacking player may choose which opponent to attack, the attacking player may attack the opponent to their left, the attacking player may attack the opponent to their right, the attacking player may attack the opponent directly opposite them, and the attacking player may attack an the next or last player in the order of play. The players may agree prior to play to the method of selecting an opponent. Selection of an opponent may also be by a method similar to those methods discussed above for selecting which player will go first. For example, an opponent may be chosen by each player that is not an attacking player, selecting a card randomly or strategically for comparison of a predetermined indicia, such as ranking or total POP. The card used to determine the opponent may returned to the player's stack or used in that round of play for comparison with the attacking player's card. Another example would include the comparison of a roll of a die or dice to determine an opponent.

Figure 10:
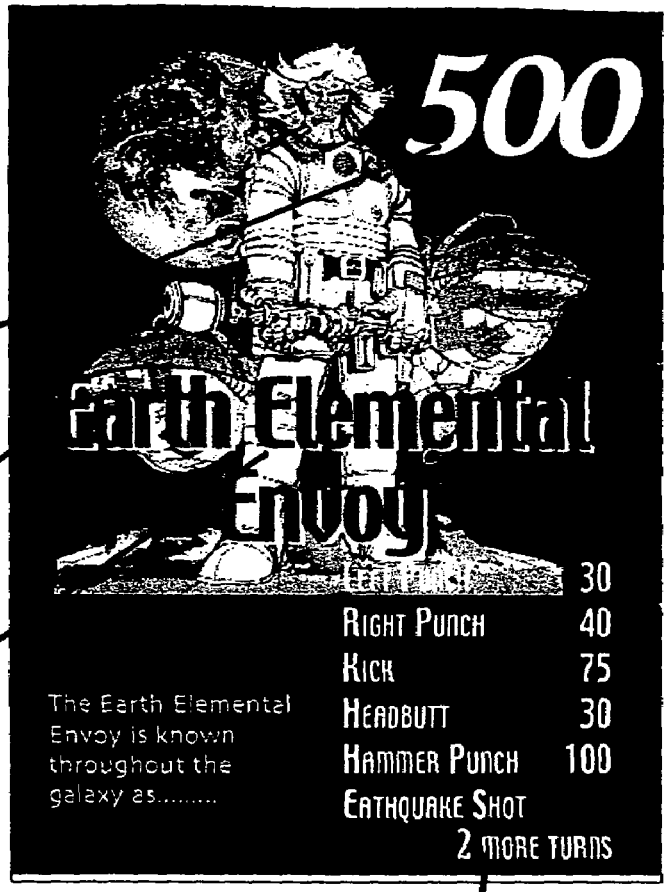
FIG. 10 shows an example of a card with an Elemental Envoy Character thereon.

Referring to another exemplary embodiment of the present invention shown in FIGS. 10 through 19, the method of playing a statistical card game is shown using the image 16 of a number of characters. The characters are a surfer, a ranger, a kid, a ninja, a monster, an octopus, a solider, an envoy, a woman, a hero, a viper, or any combinations thereof. Referring now to FIG. 10, the image 16 has the textual indicia 18 or name represented thereon.

As shown in FIG. 10, the textual indicia 18 or name on the card 10 is "Earth Elemental Envoy". The card 10 also has an image 16 of a solider or combatant. In one exemplary aspect of the present invention, each of the Earth Elemental Envoy characters may have the same or different POP 22 amounts. In this embodiment, the POP 22 amount is 500 points. However one skilled in the art should appreciate that the POP 22 amount may be the same or different for another Elemental Envoy character card 10. Below the image 16 is a number of statistics 26 of the character. These statistics 26 include, but are not limited to, different moves or attacking methods that the character can employ, and the amounts for which to subtract from the POP 22. In this embodiment, the Earth Elemental Envoy character has six attack moves. In this embodiment, the moves are a left punch with 30 points, a right punch with 40 points, a kick with 75 points, a headbutt maneuver with 30 points, a hammer punch with 100 points, and an earthquake shot that allows the player two additional turns. One skilled in the art should appreciate that the six attack moves may have different number or the same number of points.

Figure 11:
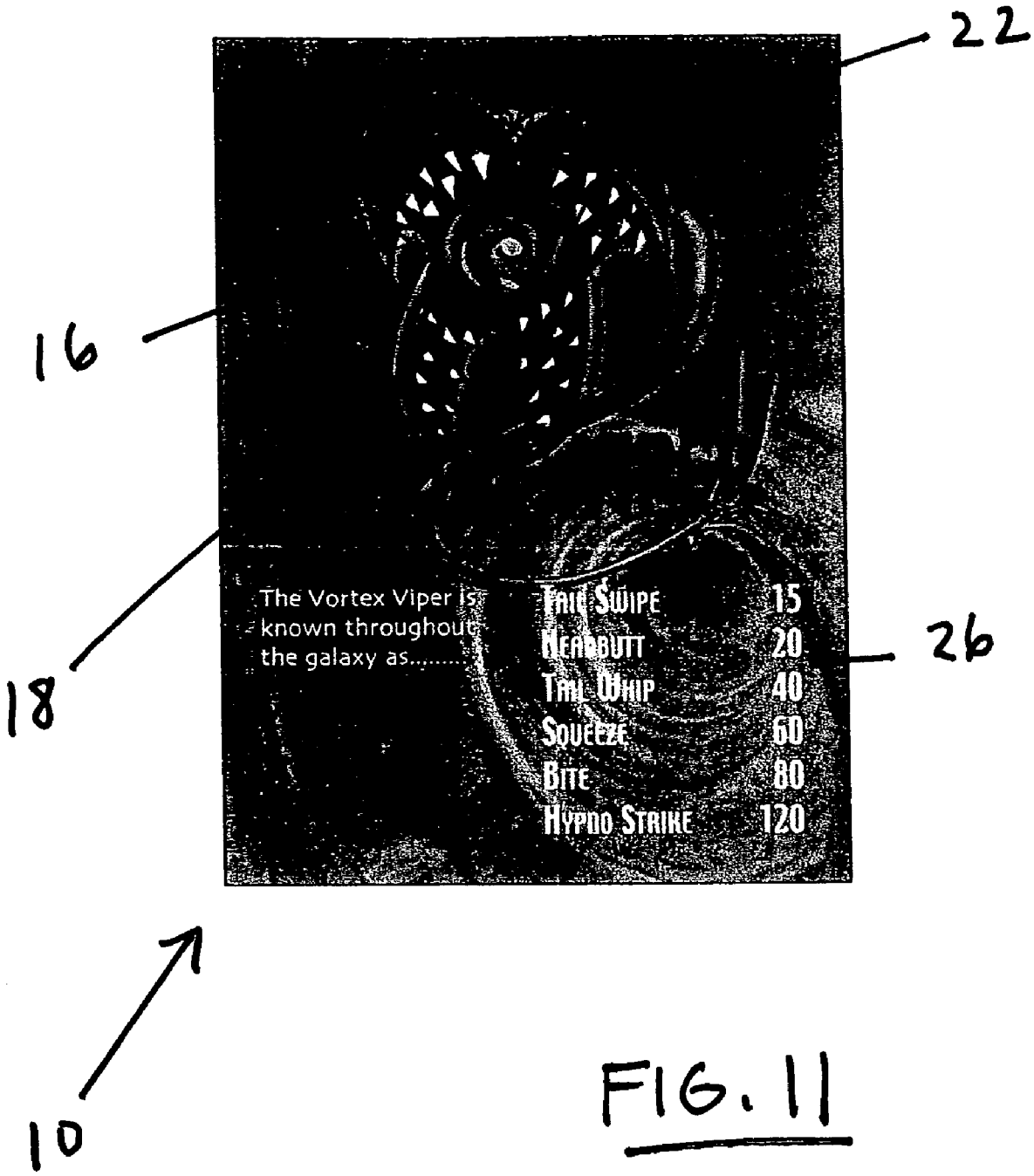
FIG. 11 shows an example of a card with a Vortex Viper Character thereon.

Referring now to FIG. 11, in another embodiment of the present invention, the textual indicia 18 or name on the card 10 is "Vortex Viper" with the image 16 of a snake type character. Again, to the right of the textual indicia 18 is the character's total Points of Pain 22. In this embodiment, the POP 22 amount is 380 points, however one skilled in the art should appreciate that the POP 22 amount may be the same or different for another Vortex Viper character card 10. Below the image 16 is a number of statistics 26 of the character. These statistics 26 include, but are not limited to, different moves or attacking methods that the character can employ, and the amounts for which to subtract from the POP 22 amount. The Vortex Viper image 16 or character has six attack moves or a tail swipe with 15 points, a head butt with 20 points, a tail whip with 40 points, a squeeze maneuver with 60 points, a bite with 80 points, and an hypnotic strike with 120 points. One skilled in the art should appreciate that the six attack moves may have different number or the same number of points with another Vortex Viper card 10.

Figure 12:
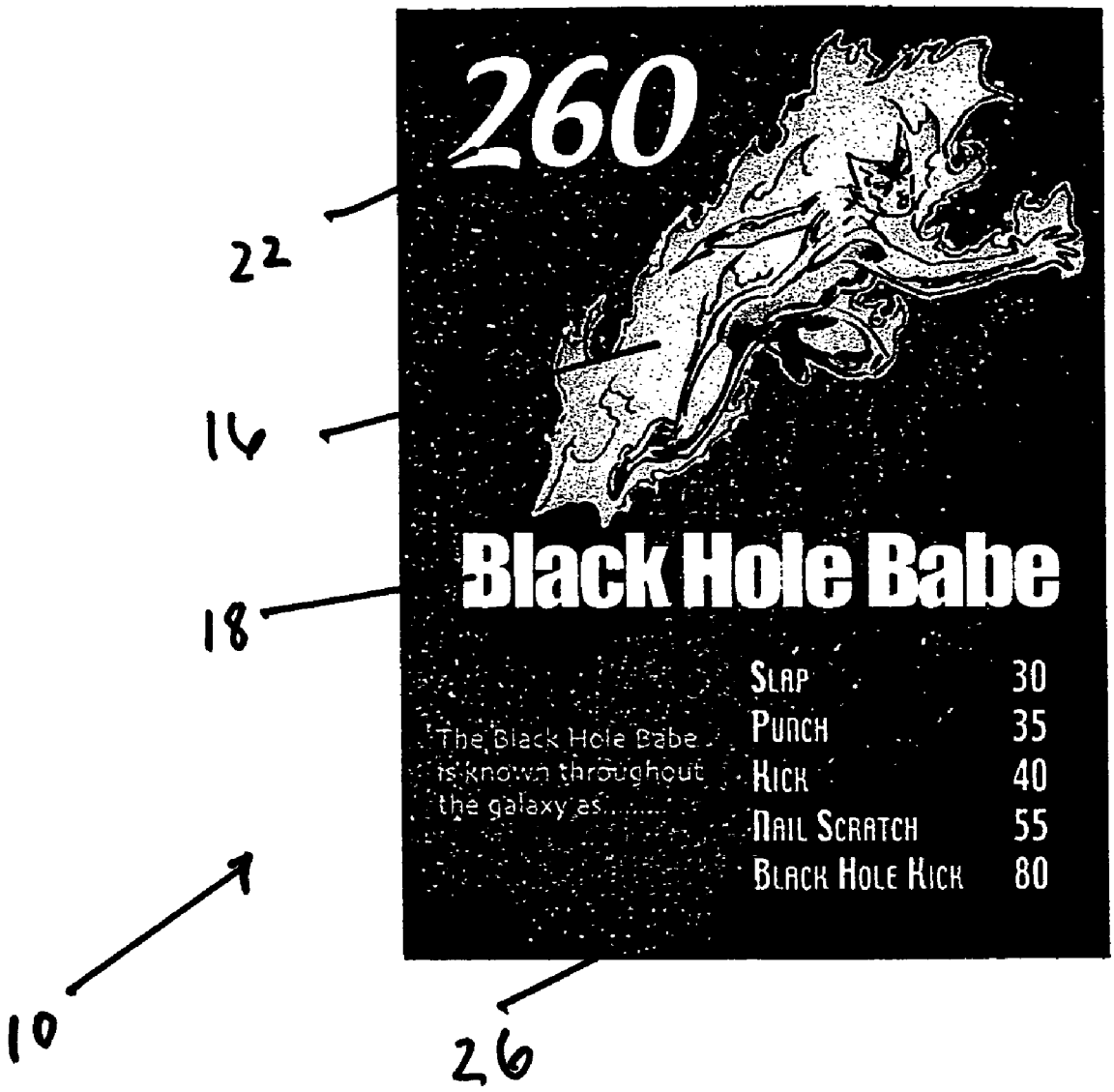
FIG. 12 shows an example of a card with a Black Hole Babe Character thereon.

Referring now to FIG. 12, the textual indicia 18 or name on the card 10 is "Black Hole Babe" with the image of a female creature. Again, to the right of the textual indicia 18 is the character's total Points of Pain 22. Each Black Hole Babe character in the deck of cards may have the same or different POP 22 amounts. In this embodiment, the POP 22 amount is 260 points. However, one skilled in the art should appreciate that the POP 22 amount may be the same or different for another character. Below the image 16 is a number of statistics 26 of the character. These statistic include, but are not limited to, different moves or attacking methods that the character can employ, and the amounts for which to subtract from the POP 22. In this embodiment, the Black Hole Bade character has five attack moves or a slap with 30 points, a punch with 35 points, a kick with 40 points, a nail scratch maneuver with 55 points, and a black hole kick with 80 points. One skilled in the art should appreciate that the attack moves may have different amounts for different cards 10.

Figure 13:
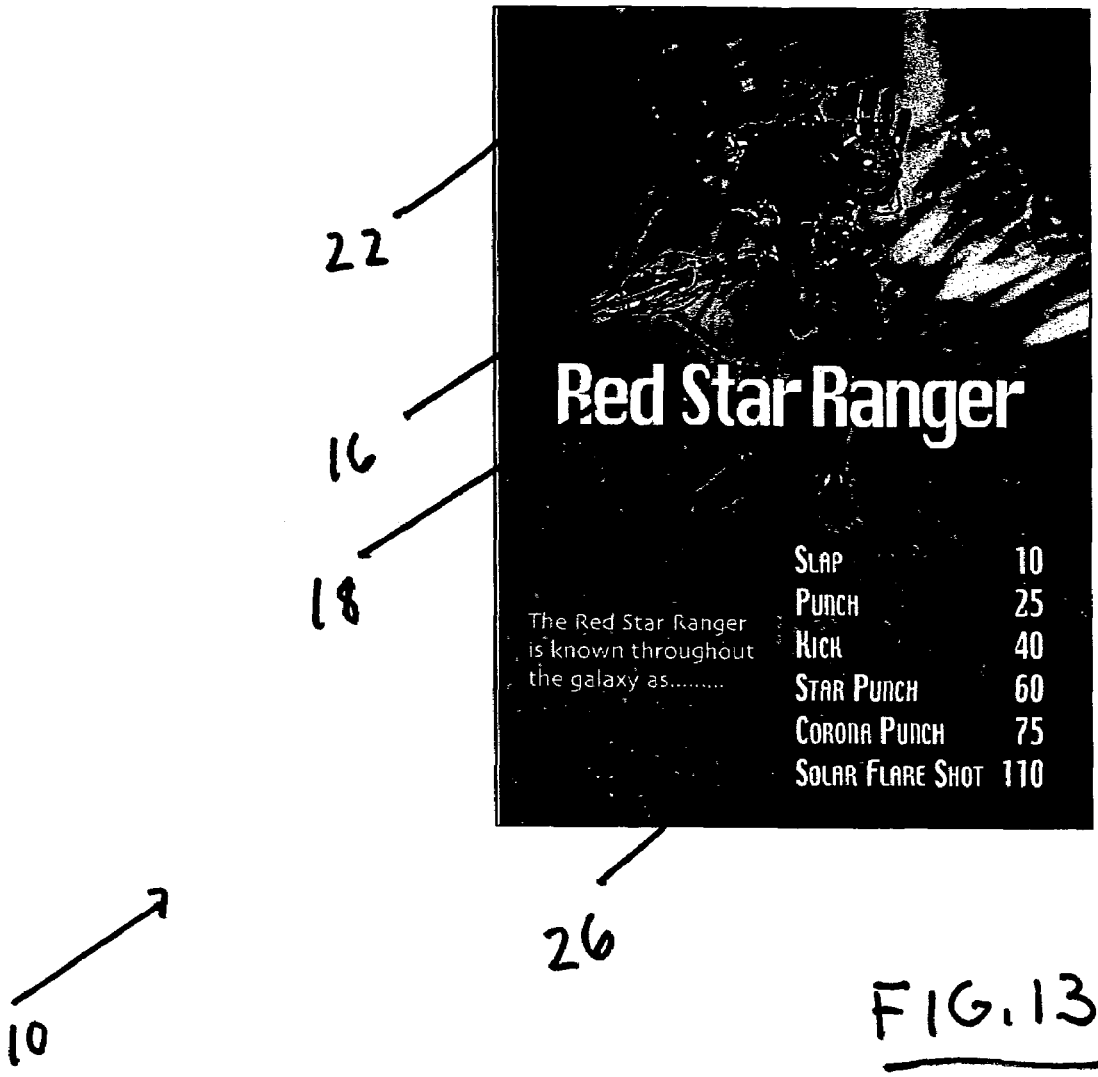
FIG. 13 shows an example of a card with a Red Star Ranger Character thereon.

Referring now to FIG. 13, the textual indicia 18 or name on the card 10 is "Red Star Ranger" with the image 16 of an alien combatant. Again, to the right of the textual indicia 18 is the character's total Points of Pain 22. Each Red Star Ranger character in the deck of cards may have the same or different POP 22 amounts. In this embodiment, the POP 22 amount is 400 points, however the POP 22 amount may be the same or different for another Red Star Ranger character. Below the image 16 is a number of statistics 26 of the character. These statistics 26 include, but are not limited to, different moves or attacking methods that the character can employ, and the amounts for which to subtract from the POP 22. In this embodiment, the Red Star Ranger character has six attack moves or a slap with 10 points, a punch with 25 points, a kick with 40 points, a star punch with 60 points, a corona punch with 75 points, and a solar flare shot with 110 points. One skilled in the art should appreciate that the attack moves may have different amounts for each Red Star Ranger card 10.

Figure 14:
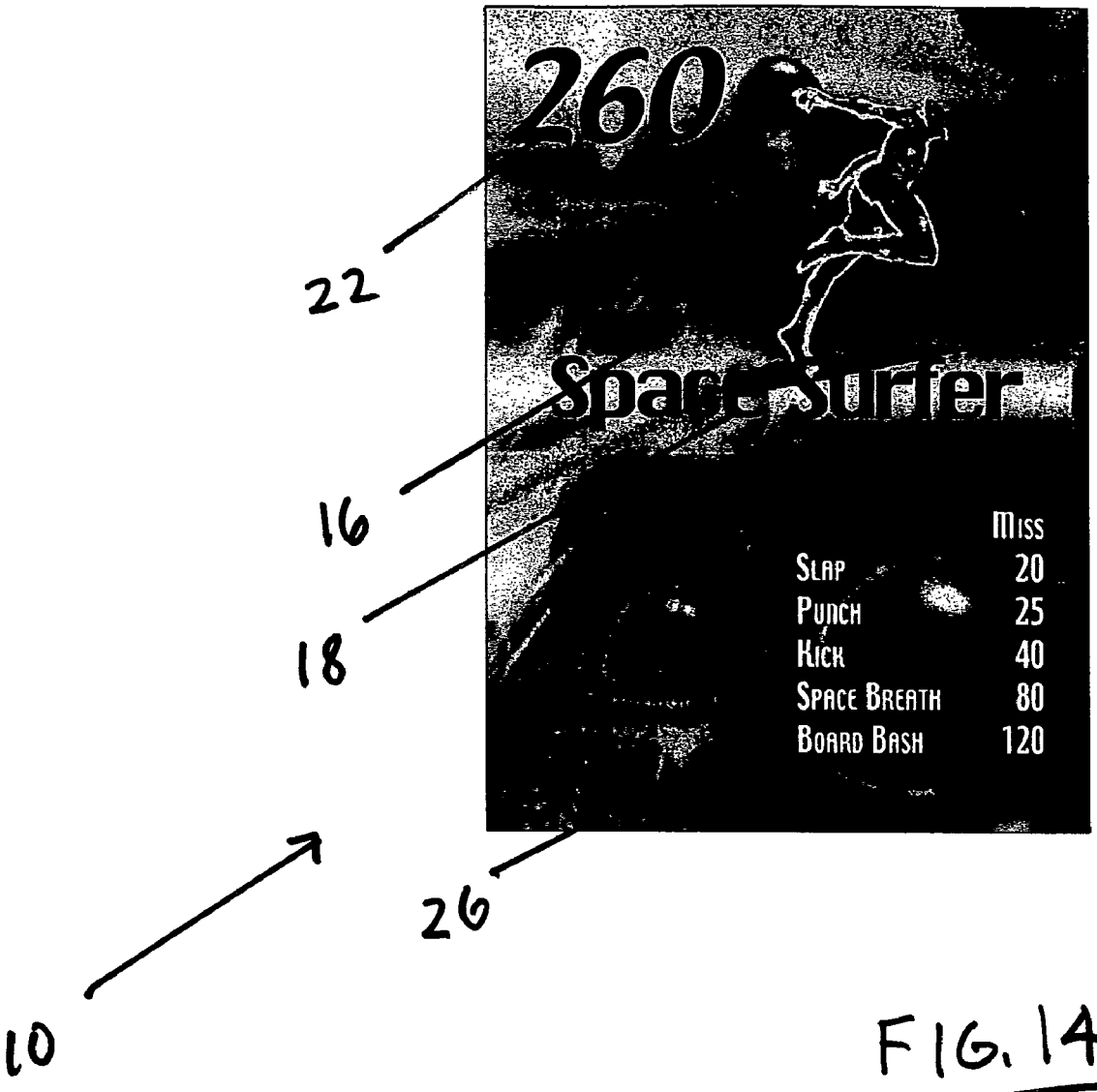
FIG. 14 shows an example of a card with a Space Surfer Character thereon.

Referring now to FIG. 14, the textual indicia 18 or name on the card 10 is "Space Surfer" with the image of an alien surfer. Again, to the right of the textual indicia 18 is the character's total Points of Pain 22. Each Space Surfer character in the deck of cards may have the same or different POP 22 amounts. In this embodiment, the POP 22 amount is 260 points, however the POP 22 amount may be the same or different for another Space Surfer character. Below the image 16 is a number of statistics 26 of the character. These statistics include, but are not limited to, different moves or attacking methods that the character can employ, and the amounts for which to subtract from the POP 22. In this embodiment, the Space Surfer character has five attack moves or a slap with 20 points, a punch with 25 points, a kick with 40 points, a space breath maneuver with 80 points, and a board bash maneuver with 120 points. One skilled in the art should appreciate that the attack moves may have different amounts for each Space Surfer card 10.

Figure 15:
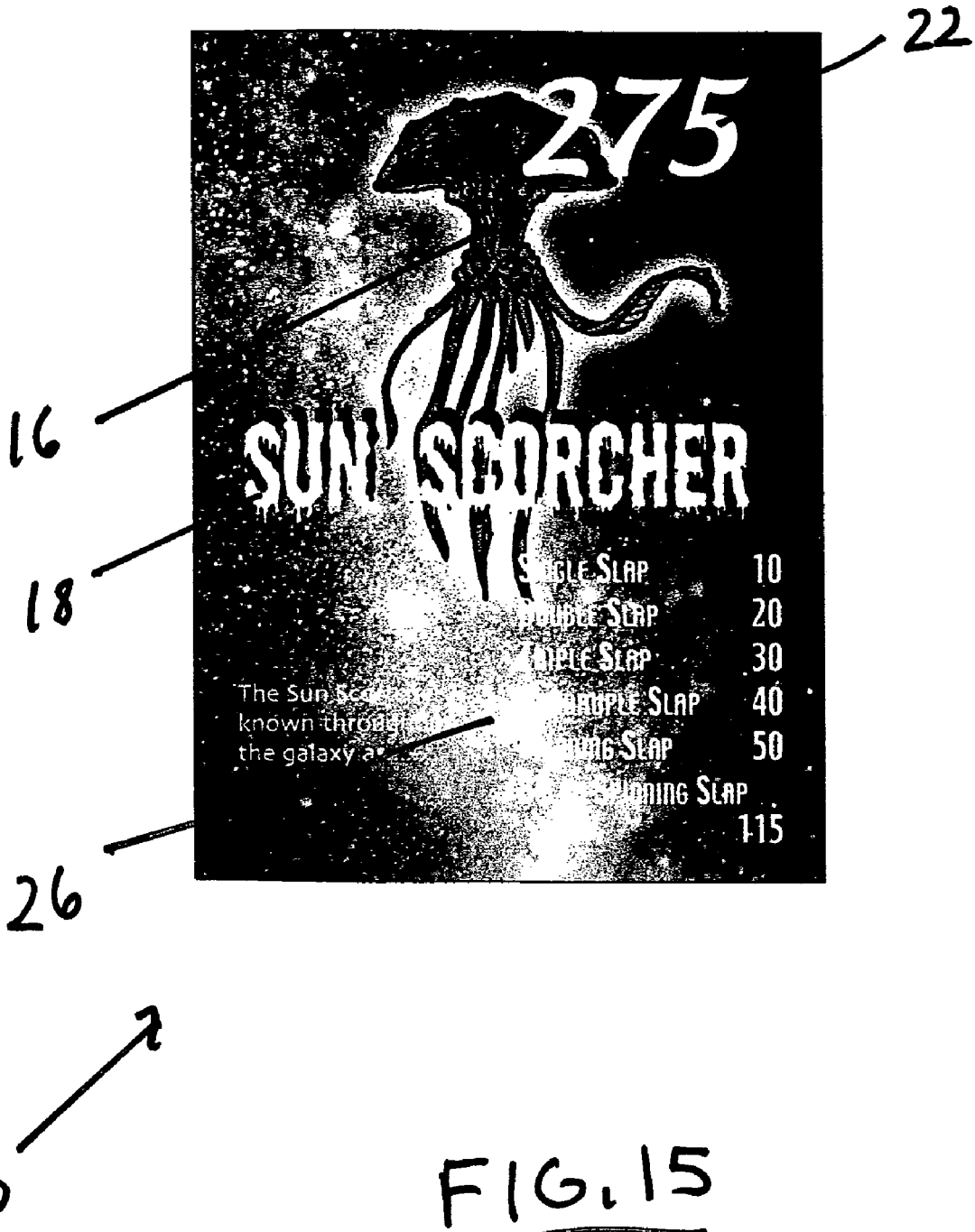
FIG. 15 shows an example of a card with a Sun Scorcher Character thereon.

Referring now to FIG. 15, the textual indicia 18 or name on the card 10 is "Sun Scorcher", which represents a space monster image 16. Again, to the right of the textual indicia 18 is the character's total Points of Pain 22. Each Sun Scorcher character in the deck of cards may have the same or different POP 22 amounts. In this embodiment, the POP 22 amount is 275 points, however the POP 22 amount may be the same or different for another Sun Scorcher character. Below the image 16 is a number of statistics 26 of the character. These statistics 26 include, but are not limited to, different moves or attacking methods that the character can employ, and the amounts for which to subtract from the POP 22. In this embodiment, the Sun Scorcher character has five attack moves or a single slap with 10 points, a double slap with 20 points, a triple slap with 30 points, a quadruple slap with 40 points, a spinning slap with 50 points, and a solar spinning slap with 115 points. One skilled in the art should appreciate that the attack moves may have different amounts for each Sun Scorcher card 10.

Figure 16:
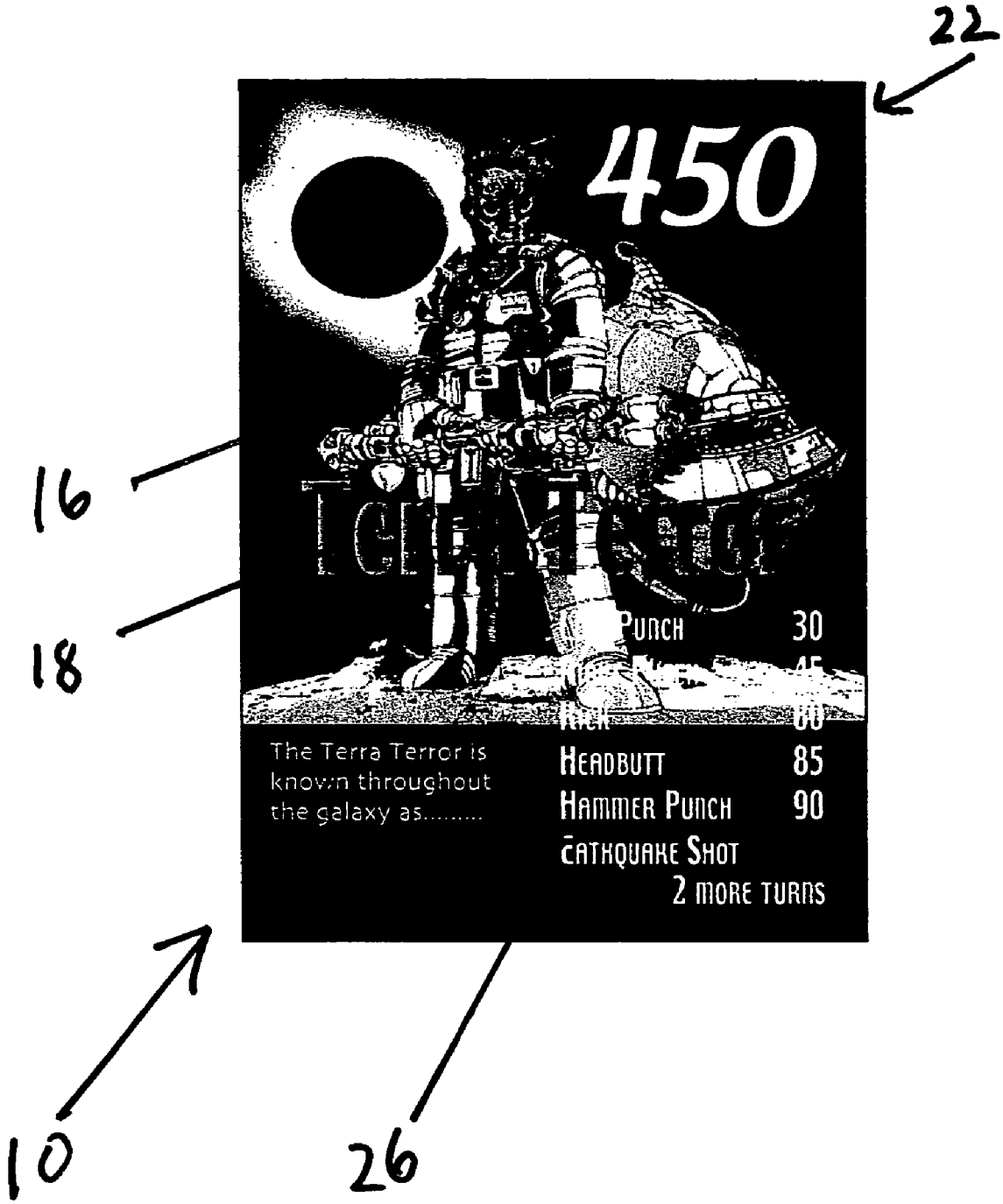
FIG. 16 shows an example of a card with a Terra Terror Solider Character thereon.

Referring now to FIG. 16, the textual indicia 18 or name on the card 10 is "Terra Terror", which represents a futuristic soldier's image 16. Again, to the right of the textual indicia 18 is the character's total Points of Pain 22. Each solider character in the deck of cards may have the same or different POP 22 amounts. In this embodiment, the POP 22 amount is 450 points, however the POP 22 amount may be the same or different for another solider character. Below the image 16 is a number of statistics 26 of the character. These statistics 26 include, but are not limited to, different moves or attacking methods that the character can employ, and the amounts for which to subtract from the POP 22. In this embodiment, the character has six attack moves or a punch with 30 points, a straight punch with 45 points, a kick with 80 points, a headbutt with 85 points, a hammer punch with 90 points, and a earth quake shot which allows the user two additional moves or turn to attack the opponent. One skilled in the art should appreciate that the attack moves may have different amounts for each solider card 10.

Figure 17:
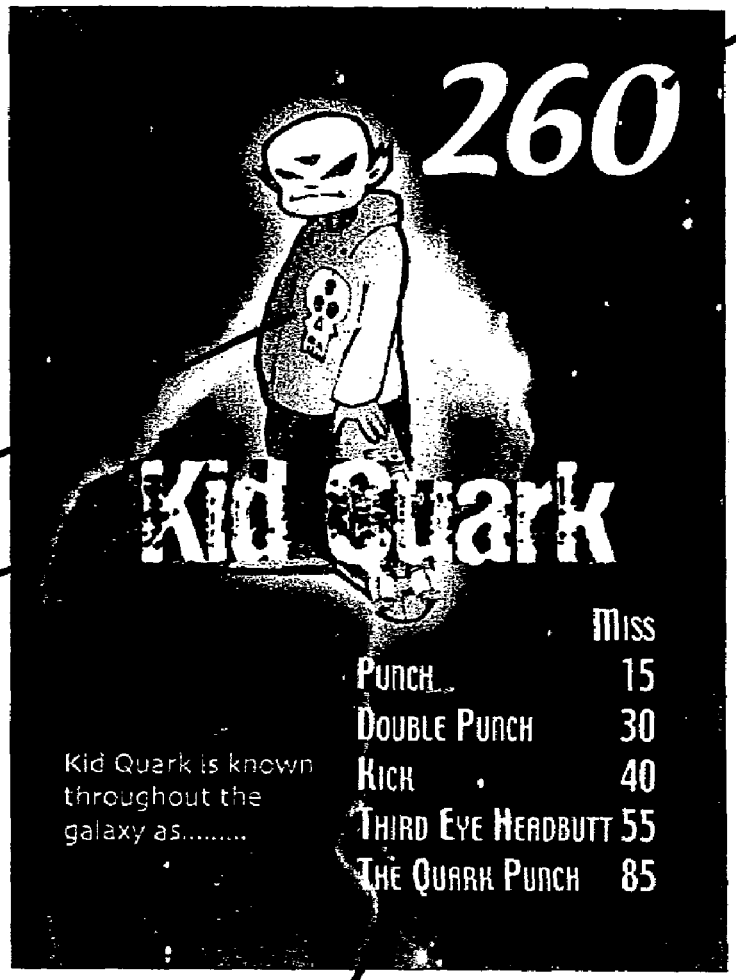
FIG. 17 shows an example of a card with a Kid Quark Character thereon.

Referring now to FIG. 17, the textual indicia 18 or name on the card 10 is "Kid Quark" which represents a futuristic alien image 16. Again, to the right of the textual indicia 18 is the character's total Points of Pain 22. Each Kid Quark character in the deck of cards may have the same or different POP 22 amounts. In this embodiment, the POP 22 amount is 260 points, however the POP 22 amount may be the same or different for another Kid Quark character. Below the image 16 is a number of statistics 26 of the character. These statistics 26 include, but are not limited to, different moves or attacking methods that the character can employ, and the amounts for which to subtract from the POP 22. In this embodiment, the character has five attack moves or a punch with 15 points, a double punch with 30 points, a kick with 40 points, a third eye headbutt with 55 points, and a quark punch with 85 points. One skilled in the art should appreciate that the attack moves or statistics 26 may have different amounts for each Kid Quark card 10.

Figure 18:
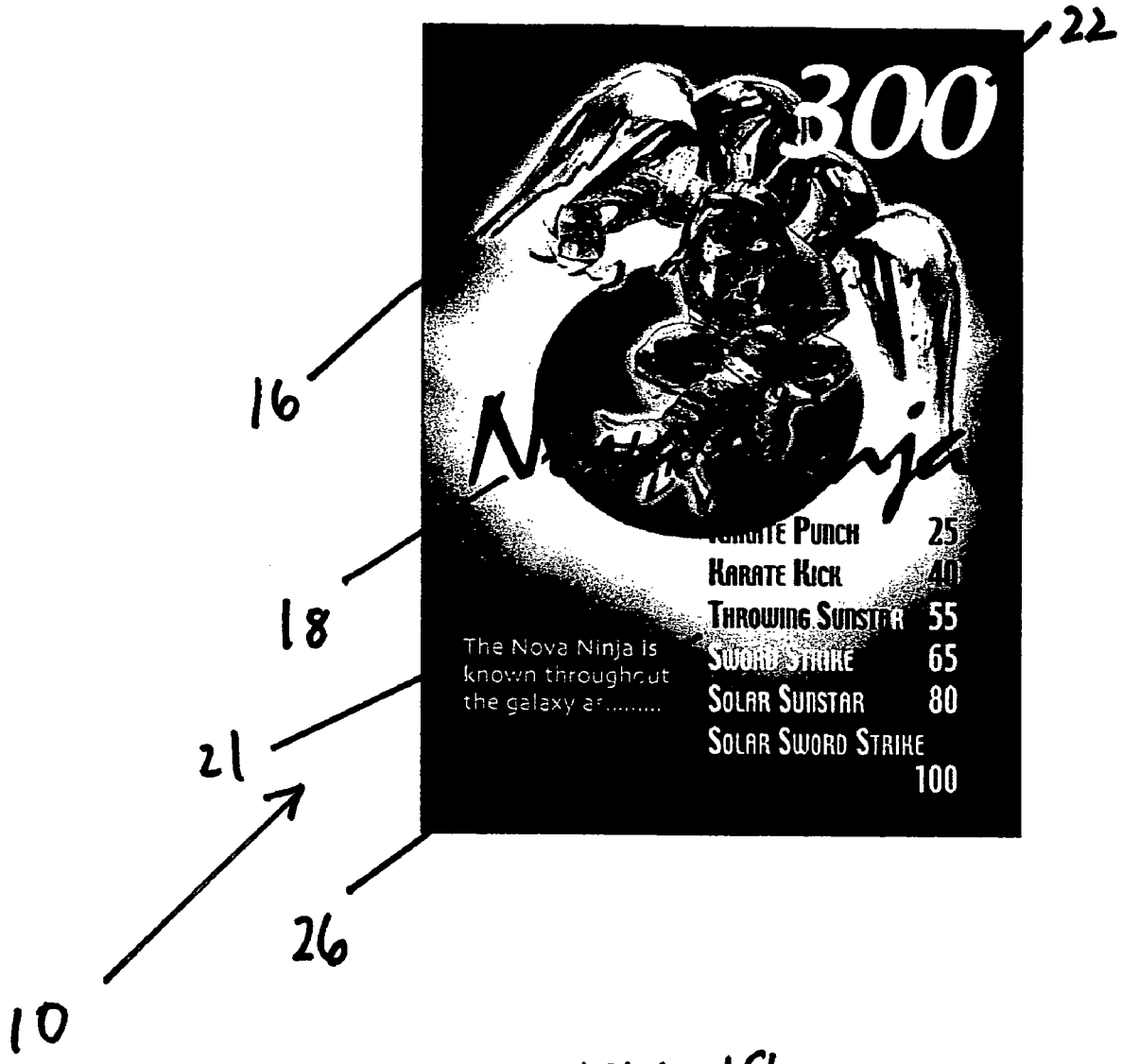
FIG. 18 shows an example of a card with a Nova Ninja Character thereon.

Referring to FIG. 18, the textual indicia 18 or name on the card 10 is "Nova Ninja" which represents the winged combatant image 16. To the right of the textual indicia 18 is the character's total Points of Pain 22. Each Nova Ninja character in the deck of cards may have the same or different POP 22 amounts. In this embodiment, the POP 22 amount is 300 points, however the POP 22 amount may be the same or different for another Nova Ninja character image 16. Below the image 16 is a number of statistics 26 of the character. These statistics 26 include, but are not limited to, different moves or attacking methods that the character can employ, and the amounts for which to subtract from the POP 22. In this embodiment, the character has six attack moves or a karate punch with 25 points, a karate kick with 40 points, a throwing sun star maneuver with 55 points, a sword strike with 65 points, a solar sun star maneuver with 80 points, and a solar sun strike punch with 100 points. One skilled in the art should appreciate that the attack moves may have different amounts for each Nova Ninja card 10.

Additionally, each card 10 may have a textual message 21 that accompanies the respective image 16. One skilled in the art should appreciate that the textual message may be any commercially acceptable message 21, puffery or saying, and the message may be complementary to the image 16.

Although many of the examples above refer to cards and methods simulating wrestling, any sport or art of engagement may be substituted therein with the same rules of play. Additionally, the cards and methods may be in an electronic format.

Thus, it can be seen from the foregoing specification and attached drawings that the card game and method of playing the same of the present invention provides an interesting and exciting ways for simulating sports and arts of encounterment.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the invention without departing from the scope thereof. Therefore, it is intended that the present invention not be limited to the particular embodiment(s) disclosed as the best mode contemplated for carrying out this disclosure, but that the invention will include all embodiments falling within the scope of the appended claims.

What is claimed is:

1. A method for playing a competitive card game simulating combat, said card game consisting of only a plurality of playing cards and a random number selection device, the method comprising the steps of:

(a) providing a playing card from said plurality of playing cards for each player, each card representing a specific character with indicia thereon, wherein said indicia has one or more attack moves of said specific character represented thereon, a rating of punishment that said one or more attack moves can inflict on an opponent, and a rating of total amount of punishment that said character represented thereon can sustain (b) each of the players sequentially selecting said attack move to be performed from the card of the player and subtracting the rating of punishment of the selected attack move from the rating of total amount of punishment of the card of another player, said sequential selection, and said subtraction continuing until one of the players depletes the total amount of punishment of the other player; and (c) each of the players using said random number selection device that provides the rating of punishment to be subtracted from the ratings of total amount of punishment of the card of each of the other players, wherein only said playing cards and the random number selection device are used by the players to play the card game.

2. The method of claim 1, wherein each card has a different total amount of punishment regardless of said specific character represented thereon.

3. The method of claim 1, wherein said one or more attack moves are chosen from the group consisting of a hammer punch, a squeeze, a tail whip, a nail scratch, a shot, a slap, a punch, a kick, a star punch, a corona punch, a solar flare shot, a headbutt, a bash, a breath, a tail slap, an eye jab, a throw, a sword strike. and any combinations thereof.

4. The method of claim 1, wherein said indicia consists of one or more attack moves, a rating of punishment that said one or more attack moves can inflict on an opponent, a rating of total amount of punishment that said character represented thereon can, sustain, and any combinations thereof, and wherein each of said indicia are different on each of said plurality of cards regardless of whether said characters are the same.

5. The method of claim 1, wherein a single card is assigned to each player.

6. The method of claim 1, wherein the total points for the attack moves and the rating of punishment is unique to each card.

7. A method for playing a competitive card game simulating combat, said card game consisting of only plurality of playing cards and a random number selection device, comprising the steps of;

(a) providing a playing card from said plurality of playing cards for each player, each card representing a specific character with indicia thereon, wherein said indicia has one or more attack moves of said specific character represented thereon, a rating of punishment that said one or more attack moves can inflict on an opponent, and a rating of total amount of punishment that said character represented thereon can sustain (b) each of the players sequentially selecting said attack move to be performed from the card of the player and subtracting the rating of punishment of the selected attack move from the rating of total amount of punishment of the card of another player, said sequential selection and said subtraction continuing until one of the players depletes the total amount of punishment of the other player; and (c) each of the players using said random number selection device that provides the rating of punishment to be subtracted from the ratings of total amount of punishment of the card of each of the other players, wherein only said playing cards and the random number selection device are used by the players to play the card game, wherein said character is selected from the group consisting of a surfer, a ranger, a kid, a ninja, a monster, an octopus, a solider, an envoy, a woman, a hero, a viper, a snake, and any combinations thereof.

8. A method for playing a competitive card game simulating combat, said card game consisting of only a plurality of playing cards and a random number selection device comprising the steps of:

(a) providing a playing card from said plurality of playing cards for each player, each card representing a specific character with indicia thereon, wherein said indicia has one or more attack moves of said specific character represented thereon, a rating of punishment that said one or more attack moves can inflict on an opponent, and a rating of total amount of punishment that said character represented thereon can sustain (b) each of the players sequentially selecting said attack move to be performed from the card of the player and subtracting the rating of punishment of the selected attack move from the rating of total amount of punishment of the card of another player, said sequential selection and said subtraction continuing until one of the players depletes the total amount of punishment of the other player; and (c) each of the players using said random number selection device that provides the rating of punishment to be subtracted from the ratings of total amount of punishment of the card of each of the other players, wherein only said playing cards and the random number selection device are used by the players to play the card game, and wherein each turn taken by an attacking player results in punishment points being subtracted from the total amount of punishment of the card of a competing player.

9. The method of claim 8, wherein a single card is assigned to each player.

10. The method of claim 8, wherein the total points for the attack moves and the rating of punishment is unique to each card.

11. The method of claim 8, further comprising a modification card that is chosen to modify the attack move point value.

12. The method of claim 11, wherein the modification card lower the attack move value.

13. The method of claim 11, wherein the modification card raises the attack move point value.

14. The method of claim 8, further comprising the step of having each player select cards prior to game play, wherein the selected cards are awarded to the player with punishment points remaining at an end point of the game.

* * * * *